US006839530B2

(12) United States Patent
Takahashi et al.

(10) Patent No.: US 6,839,530 B2
(45) Date of Patent: Jan. 4, 2005

(54) IMAGE FORMING APPARATUS WITH IMAGE BEARING MEMBER PARTICLE COLLECTION USING TIMED VOLTAGE APPLICATION TO THE APPARATUS DEVELOPING UNIT

(75) Inventors: Norio Takahashi, Susono (JP); Jun Hirabayashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/356,583

(22) Filed: Feb. 3, 2003

(65) Prior Publication Data

US 2003/0161660 A1 Aug. 28, 2003

(30) Foreign Application Priority Data

Feb. 1, 2002 (JP) ..... 2002-025265

(51) Int. Cl.[7] ..... G03G 15/30; G03G 15/02
(52) U.S. Cl. ..... 399/149; 399/176
(58) Field of Search ..... 399/168, 174, 399/176, 149, 150

(56) References Cited

U.S. PATENT DOCUMENTS

| | | | | |
|---|---|---|---|---|
| 4,851,960 A | | 7/1989 | Nakamura et al. | 361/225 |
| 5,809,379 A | | 9/1998 | Yano et al. | 399/159 |
| 6,088,548 A | * | 7/2000 | Hashimoto et al. | |
| 6,134,407 A | | 10/2000 | Ishiyama et al. | 399/174 |
| 6,173,144 B1 | | 1/2001 | Hirabayashi et al. | 399/222 |
| 6,442,362 B2 | | 8/2002 | Hirabayashi et al. | 399/149 |
| 6,591,072 B2 | * | 7/2003 | Hashimoto et al. | 399/174 |
| 2002/0141783 A1 | | 10/2002 | Ishiyama et al. | 399/175 |

FOREIGN PATENT DOCUMENTS

| | | | | |
|---|---|---|---|---|
| JP | 63-149669 | | 6/1988 | |
| JP | 6-3921 | | 1/1994 | |
| JP | 7-99442 | | 10/1995 | |
| JP | 09134105 A | * | 5/1997 | G03G/21/10 |
| JP | 10-307454 | | 11/1998 | |

* cited by examiner

*Primary Examiner*—Susan Lee
(74) *Attorney, Agent, or Firm*—Fitzpatrick, Cella, Harper & Scinto

(57) ABSTRACT

An image forming apparatus includes an image bearing member; a charging roller cooperable with the image bearing member to form a nip therebetween, for charging the charging roller is rotatable for counterdirectional peripheral movement relative to the image bearing member at the nip; a developing unit for developing with a developer an electrostatic image formed on the image bearing member; wherein the potential of a potential changing portion of the image bearing member changes with respect to the peripheral moving direction of the image bearing member; and wherein at tA (sec) after arrival at an upstream end of the nip, of the potential changing portion, the developing unit is supplied with a voltage for collecting particles from the image bearing member to the developing unit, where tA (sec) is a sum of a time duration required for a surface of the charging roller to move from the upstream end of the nip to a downstream end of the nip and a time duration required for a surface of the image bearing member to move from the downstream end of the nip to a developing zone of the developing unit.

21 Claims, 20 Drawing Sheets

IMAGE FORMING APPARATUS WITH IMAGE BEARING MEMBER PARTICLE COLLECTION USING TIMED VOLTAGE APPLICATION TO THE APPARATUS DEVELOPING UNIT

FIELD OF THE INVENTION AND RELATED ART

The present invention relates to an image forming apparatus equipped with a charging member which rotates in the direction opposite to the moving direction of the surface of an image bearing member. More specifically, it relates to an image forming apparatus, which is equipped with a charging member which rotates in the direction opposite to the moving direction of the surface of an image bearing member, and which recovers into the developing device the excessive amount of particles expelled from the charging member onto the image bearing member in response to the changes in the surface potential level of the image bearing member.

In the past, a corona type charging device (corona discharger) has been used as a charging apparatus for uniformly charging (inclusive of discharging) an image bearing member, such as an electrophotographic photoconductive member, an electrostatically recordable dielectric member, etc., employed by an image forming apparatus which used an electrophotographic method, an electrostatic recording method, etc., to predetermined polarity and potential level.

A corona type charging device is a noncontact type charging apparatus. It has a corona discharging electrode, for example, a piece of metallic wire or the like, and a shield electrode which surrounds the corona discharging electrode. It is disposed so that the opening of the shield electrode, through which corona is discharged, faces an image bearing member, an object to be charged, with the presence of a gap between the corona discharging electrode and the image bearing member. In operation, the surface of the image bearing member is charged to the predetermined specifications by exposing the surface of the image bearing member to the discharge current (corona shower) which occurs as high voltage is applied between the corona discharging electrode and shield electrode.

In recent years, however, there have been a substantial number of proposals to use a contact type charging apparatus as a charging device for charging an object such as an image bearing member, because a contact type charging apparatus is superior to a corona type charging device, a noncontact type charging device, in that the former is smaller in the amount of ozone production, power consumption, etc., than the latter. Further, some of these proposals have already been put to practical use.

A contact type charging apparatus comprises an electrically conductive charging member in the form of a roller (charge roller), a fur brush, a magnetic brush, a blade, etc., which is placed in contact with an object to be charged, such as an image bearing member. In operation, a predetermined charge bias is applied to the charging member (contact type charging member, contact type charging device, etc., which hereinafter will be referred to simply as contact charging member) to charge the surface of an object to be charged, to predetermined polarity and potential level.

The charging mechanism (principle base on which object is charged) of a contact charging method is a mixture of two charging mechanisms: (1) charging mechanism based on discharge, and (2) direct charging mechanism. Thus, which of the two mechanisms is dominant characterizes each contact charging method.

(1) Electrical discharge type charging mechanism

This is a charging mechanism in which the surface of an object to be charged becomes electrically charged due to the electrical discharge which occurs across the minute gap between a contact charging member and the object to be charged.

Thus, in order for a discharge type charging mechanism to work, electrical discharge must occur between a contact charging member and an object to be charged; in other words, the voltage applied between the contact charging member and the object must be greater than the threshold voltage, that is, the voltage above which electrical discharge occurs. Therefore, a voltage greater in potential level than the potential level to which the object is to be charged must be applied to the contact charging member. Further, in comparison to a corona type charging device, a discharge type charging mechanism is substantially smaller in the amount of ozone production. However, in principle, it is impossible for a discharge type charging mechanism to produce no by-product of electrical discharge. Therefore, when a discharge type charging mechanism is employed, it is impossible to avoid the problems associated with active ions such as ozone.

(2) Injection type charging mechanism

This is a charging mechanism in which the surface of an object to be charged becomes electrically charged as electrical charge is directly injected from a contact charging member into the object. It is called direct charging mechanism or injection charging mechanism (which hereinafter will be referred to as injection charging mechanism).

More specifically, according to this mechanism, a contact charging member, the electrical resistance of which is in the mid range, is placed directly in contact with an object to be charged, to inject electrical charge directly into the surface of the object to be charged. Thus, in principle, the object becomes electrically charged without the presence of electrical discharge. Therefore, the object becomes charged to a predetermined potential level even if the potential level of the voltage applied to the contact charging member is below the aforementioned threshold voltage. Without the presence of electrical discharge, this charging mechanism, or injection charging mechanism, does not produce ions. Therefore, it does not suffer from the problems associated with the by-products of electrical discharge.

However, an injection charging mechanism is a direct charging mechanism. Therefore, the state of contact between a contact charging member and an object to be charged greatly affects the charging performance of an injection charging mechanism. Thus, the contact charging member used by an injection charging mechanism is required to be higher in density, is greater in the surface velocity relative to the surface of the object to be charged, and is greater in the frequency of its contact with the object to be charged, than the charging member used in the preceding charging mechanism.

A) Charge roller

Among various contact charging apparatuses, a roller type charging apparatus, which employs an electrically conductive roller (charge roller), is desirable from the standpoint of stable charging performance, and therefore, is widely used. In the case of this roller type charging apparatus, the charging mechanism (1) based on electrical discharge is the dominant charging mechanism.

A charge roller is formed of a rubbery substance, or a foamed substance, the electrical resistance of which is in the mid range. In some cases, two or more charge roller materials are layered in order to obtain a charge roller with the desired characteristics.

In order to maintain a certain state of contact between an object to be charged (which hereinafter will be referred to as photoconductive member) and a charge roller, a charge roller is given elasticity. Therefore, a charge roller is relatively large in frictional resistance. Thus, in many cases, a charge roller is driven by the rotation of a photoconductive member; in some cases, it is independently driven with the presence of a slight difference in surface velocity between the charge roller and photoconductive member. Therefore, an attempt to use a charge roller to directly inject electrical charge into a photoconductive member cannot avoid the phenomenon that the surface of the photoconductive member is nonuniformly charged due to the deterioration of charging performance in absolute terms, unsatisfactory state of contact, irregularities of the peripheral surface of a charge roller, foreign substances adhering to the peripheral surface of a photoconductive member, etc. Thus, in the case of a conventional roller type charging apparatus, the charging mechanism based on electrical discharge type is also the dominant charging mechanism.

FIG. 15 is a graph showing the charging efficiency of a typical contact charging apparatus. The axis of abscissas represents the potential level of the bias applied to the contact charging member, and the axis of ordinates represents the resultant potential level of a photoconductive member.

The characteristics of the conventional charging apparatus are represented by Line A; the photoconductive member is charged only when the voltage applied to the charge roller is greater than the electrical discharge threshold voltage, which in this case is approximately −500 V. Thus, in order to charge the photoconductive member to −500 V, generally, a DC voltage of −1,000 V, or the combination of a DC voltage of −500 V and an AC voltage having a peak-to-peak voltage of −1,200 V, is applied to the charge roller so that the potential level of the photoconductive member converges to the desired level. The AC voltage having a peak-to-peak voltage of −1,200 V is for providing between the charging member and photoconductive member, a potential difference greater than the electrical discharge threshold voltage.

To describe more concretely, when using a charge roller to charge an organic photoconductive member having a 25 μm thick organic photoconductor layer, a voltage higher than approximately 640 V must be applied to the charge roller. As long as the voltage applied to the charge roller is higher than approximately 640 V, the higher the voltage applied to the charge roller, the higher the resultant potential level of the photoconductive member; the two voltages are proportional, with the inclination of Line A being 1. Hereinafter, this threshold voltage value will be referred to as charge starting voltage Vth. In other words, in order to charge the surface of the photoconductive member to a voltage level of Vd necessary for electrophotography, it is necessary to apply to the charge roller, a DC voltage of Vd+Vth, which is much higher than the desired voltage to which the surface of the photoconductive member is to be charged.

A method such as the above described one which applies only a DC voltage to a contact charging member to charge an image bearing member is called "DC charging method". The electrical resistance of a contact charging member is affected by changes in environmental factors. Further, as a photoconductive member as an image bearing member is shaved, the photoconductor layer of a photoconductive member changes in thickness, which affects the value of the charge starting voltage Vth. Thus, it is difficult to charge a photoconductive member to a desired potential level using a DC charging method.

Thus, a so-called "AC charging method", such as the one disclosed in Japanese Laid-open Patent Application 63-149669, etc., has come to be used to more uniformly charge a photoconductive member. According to this charging method, in order to charge an image bearing member to a desired potential level Vd, an oscillatory voltage, that is, the combination of a DC voltage, the potential level of which is equivalent to the potential level Vd, and an AC voltage, the peak-to-peak voltage of which is greater than 2×Vth, is applied to a contact charging member. In other words, this charging method utilizes the effect that potential level of the image bearing member is averaged by AC voltage. When this method is employed, the potential level of an image bearing member converges to the desired level Vd, which coincides with the mid point of the top and bottom peaks of the applied AC voltage, and therefore is not affected by external disturbances such as changes in environmental factors.

In principle, however, even a contact charging apparatus, such as the above described one, relies on the electrical discharge from a charging member to an image bearing member. Thus, it requires, as described above, a voltage, the potential level of which is no less in value than the sum of the value of the potential level to which an image bearing member is to be charged, and the discharge starting threshold value. It also produces ozone, although by only a small amount. Further, as AC voltage is added to uniformly charge an image bearing member, not only is the amount of ozone production increased, but also a contact charging member and a photoconductive member are vibrated by the electrical field generated by the AC voltage, generating noises (AC charge noise). In addition, the deterioration of the surface of a photoconductive member is exacerbated by the electrical discharge. In other words, the employment of the so-called AC charging method has resulted in the creation of new problems.

B) Fur brush type charging apparatus

A fur brush type charging apparatus employs, as a contact charging member, a component (fur brush type charging device) having a brush portion formed of electrically conductive fibers. In operation, the electrically conductive fiber brush portion is placed in contact with a photoconductive member as an object to be charged, and a predetermined charge bias is applied to the fur brush to charge the surface of the photoconductive drum to predetermined polarity and potential level.

Also in the case of this fur brush type charging apparatus, its charging mechanism is dominated by the aforementioned electrical discharge based charging mechanism (1).

A fur brush type charging device has been realized in two types: fixed type and roller type. A fixed type comprises an electrode, and a sheet of pile of electrically conductive fibers with a medium resistance, glued to the electrode. A roller type comprises a metallic core in the form of a roller, and a sheet of pile, similar to the above described one, glued to the peripheral surface of the metallic core in a manner to wrap the core. It is relatively easy to produce a fur brush with a fiber density of approximately 100 fiber/mm$^2$. However, in order to directly charge a photoconductive member to a satisfactory potential level and a satisfactory level of uniformity, a fur brush type with a fiber density of 100 fiber/cm$^2$ is unsatisfactory in terms of the state of contact between the brush and photoconductive member. Thus, in order to charge a photoconductive member to a satisfactory potential level and a satisfactory level of uniformity, it is necessary to provide between the peripheral surface of the photoconductive member and the apparent surface of the fur brush, a velocity difference virtually impossible to realize with the use of a mechanical structure. In other words, it is not realistic to employ a fur brush type charging member to satisfactory charge a photoconductive member.

In terms of charging performance, a fur brush type charging apparatus shows the characteristic represented by Line B in FIG. 10. In other words, also in the case of a fur brush type charging apparatus, a photoconductive member is charged mostly through the charging mechanism based on electrical discharge, that is, a charging mechanism in which a charge bias of high voltage must be applied, whether the fur brush is of a fixed type or a roller type.

C) Magnetic brush type charging apparatus

A magnetic brush type charging apparatus employs, as a contact charging member, a component (magnetic brush type charging device) having a magnetic brush portion, that is, a brush-like agglomeration of electrically conductive magnetic particles, which is realized by magnetically confining electrically conductive magnetic particles with the use of a magnetic roll or the like. In operation, the magnetic brush portion is placed in contact with the photoconductive member as an object to be charged, and a predetermined charge bias is applied to the magnetic brush type charging member to charge the surface of the photoconductive member to predetermined polarity and potential level.

In the case of this magnetic brush type charging apparatus, its charging mechanism is dominated by the aforementioned injection charging mechanism (2).

As long as electrically conductive magnetic particles, the diameters of which fall within the range of 5–50 $\mu$m, are used as the material for forming a magnetic brush, and a sufficient amount of velocity difference is provided between the peripheral surface of a photoconductive member and the apparent surface of the magnetic brush, the photoconductive member can be uniformly charged by a magnetic brush type charging apparatus.

With the use of a magnetic brush type charging apparatus, a photoconductive member can be charged to a potential level virtually equal to the applied bias, as indicated by Line C in the charging performance graph in FIG. 10.

However, a magnetic brush type charging apparatus also has problems, which are different from those of the preceding direction charging apparatuses, for example, the problems that it is complicated in mechanical structure; the electrically conductive magnetic particles, which make up the magnetic brush portion, fall by a certain amount and adhere to a photoconductive member; and the like.

There is disclosed in Japanese Laid-open Patent Application 6-3921, a contact charging method which charges the surface of a photoconductive member by directly injecting electrical charge into the charge holding substances such as electrically conductive particles, in the charge injection layer, that is, the surface layer of the photoconductive member. This method does not rely on electrical discharge. Therefore, the voltage required to charge a photoconductive member has only to be equal in polarity and potential level to the desired voltage to which the surface of the photoconductive member is to be charged. Further, it does not produce ozone.

Further, in the case of the above described contact charging method, AC voltage is not applied. Therefore, the so-called AC charge noises do not occur. In other words, this charging method is superior to a roller type charging method, in that the former is ozone-free and is smaller in power consumption than the latter.

D) Cleaner-less charging system (toner recycling system)

The transfer residual developer (toner), that is, the developer remaining on a photoconductive member (image bearing member) after image transfer in a transfer type image forming apparatus, is removed as waste toner from the surface of the photoconductive member by a cleaner (cleaning apparatus). It is desired that this waste toner is not produced even from the standpoint of environmental protection. Thus, a cleaner-less image forming apparatus began to appear in the market place. A cleaner-less image forming apparatus does not have a cleaner, and is structured so that the developer remaining on a photoconductive member after image transfer is recovered into a developing apparatus through a "development/cleaning process" carried out by the developing apparatus, and is reused by the developing apparatus.

The "development/cleaning process" is a process in which the developer remaining on a photoconductive member after image transfer is recovered during the following development processes, by the fog prevention bias (difference Vback in potential level between DC voltage applied to developing apparatus and surface potential level of photoconductive member). This cleaning method recovers the transfer residual developer into a developing apparatus, and reuses it in the following development processes, producing therefore no waste toner, and also reducing the amount of the labor required for maintenance. Further, being cleaner-less is advantageous in terms of spatial efficiency; it makes it possible to substantially reduce image forming apparatus size.

As described above, a cleaner-less image forming apparatus does not remove the transfer residual toner from the surface of a photoconductive drum with the use of a cleaner dedicated to the removal of the transfer residual toner. Instead, it moves the transfer residual toner through the charging station, and then moves to it a developing apparatus, in which the transfer residual toner is reused during the development process. Thus, if a contact charging apparatus is used as a means for charging a photoconductive member, how to satisfactorily charge a photoconductive member while developer, which is electrical nonconductive, is present in the contact area between photoconductive member and contact charging member, is a grave concern.

In the case of most of the aforementioned roller type charging apparatuses and fur brush type charging apparatuses, the transfer residual toner on a photoconductive member is dispersed by a roller or a brush, losing the pattern in which it remained, and also, relatively large bias is applied to use electrical discharge to charge a photoconductive member. In comparison, in the case of magnetic brush type charging apparatuses, a powdery substance is used as a contact charging member, enjoying the benefit that a photoconductive member can be charged by being touched by a soft contact charging means, that is, the magnetic brush portion made up of a powdery substance, that is, electrically conductive magnetic particles. However, a magnetic brush type charging apparatus is complicated in structure. Further, electrically conductive magnetic particles, which make up a magnetic brush portion, fall by a certain amount, creating a serious problem.

E) Coating of contact charging member with powdery substance

There is disclosed in Japanese Patent Application Publication 7-99442 a structure for coating a contact charging member of a contact charging apparatus with powdery substance, across the area which contacts an object to be charged, for the purpose of preventing the contact charging member from nonuniformly charging the object, in other words, to assure that the contact charging member will uniformly charge the object. The contact charging member in this contact charging apparatus is rotated by the rotation of the object to be charged, and produces a substantially smaller amount of by-products such as ozone than a corona type charging device, for example, Scorotron. However, in principle, it also primarily relies, like the aforementioned corona type charging device, on electrical discharge. Further, in order to reliably and uniformly charge an object, AC voltage is applied in addition to DC voltage, adding to the amount of the ozone.

Thus, if a cleaner-less charging apparatus of the above described type is used for a long period of time, the problems, such as the formation of an image with the flowing appearance traceable to ozone by-products, is likely to occur.

F) Injection charging apparatus, which provides velocity difference between charging member and object to be charged, and maintains electrically conductive particles between charging member and object As described above, it is difficult to satisfactorily charge an object with the use of a simply structured direct charging apparatus, for example, a direct charging apparatus employing a charge roller or a fur brush as a contact charging member. In other words, an image forming apparatus employing a simply structured direct charging apparatus is likely to form images with the foggy appearance (in reversal development process, toner is adhered to areas corresponding to white areas of original) traceable to insufficient charging of the image bearing member, in absolute terms, and images reflecting nonuniform charging of the photoconductive member.

Further, if a cleaner-less image forming apparatus employing a contact charging apparatus, the contact charging member of which is coated with powdery substance, across the surface which contacts an object to be charged, and is moved by the movement of the object to be charged, is used for a long period of time, it is likely to begin to form images with the flowing appearance traceable to the accumulation of ozone by-products. Further, in a cleaner-less image forming apparatus, the transfer residual toner travels to the charging station, and is likely to cause the direct charging member to unsatisfactorily charge the photoconductive member.

Thus, a charging method for ensuring that a photoconductive member is uniformly charged with the use of a simple contact charging member, for example, a charge roller, fur brush, etc., while requiring the application of relatively low voltage and producing virtually no ozone, even if the simple contact charging member is used for a long period of time, is proposed in Japanese Laid-open Patent Application 10-307454. According to this application, it is possible to realize an image forming apparatus, which is simple in structure, is inexpensive, and yet, is free of the problems traceable to ozone and its by-products and the problems traceable to unsatisfactory charging of a photoconductive member.

More specifically, according to the proposal in the above application, the charging method is characterized in that a flexible charging member capable of forming a relatively large contact area (which hereinafter will be referred to as charging nip, or simply, nip) between itself and the object to be charged, is employed as a contact charging member, to which voltage is applied; the surface of the charging member is moved with the presence of velocity difference between the surface of the charging member and the surface of the object to be charged; and a certain amount of electrically conductive particles is present at least between the charging member and the object to be charged.

In order to satisfactorily charge a photoconductive member, there must be a certain amount of velocity difference between the surface of a charging member and the surface of an object to be charged. Thus, for practicality, the charging member is rotated so that its peripheral surface moves opposite to the moving direction of the surface of the object to be charged, in the charging nip between the two; in other word, the charging member is counter rotated relative to the object to be charged.

A charging method using a magnetic brush can be listed as one of the charging methods in which a charging member is counter rotated as described above. When a charge roller is used as a contact charging member, and is counter rotated, in other words, rotated in such a direction that the surfaces of the charge roller and an object to be charged, move in the opposite directions in the charging nip between the object (image bearing member) to be charged, and charge roller, particles such as developer particles collect in the upstream adjacencies of the nip, in terms of the direction in which the surface of the object to be charged moves. This phenomenon is more apparent in a cleaner-less image forming apparatus; without a cleaner for removing the particles such as developer particles from an image bearing member as an object to be charged, a larger amount of particles collects in the upstream adjacencies of the object to be charged. The particles having collected in the upstream adjacencies of the nip are expelled by an excessive amount onto the surface of the object to be charged by way of the peripheral surface of the charge roller, contributing to the formation of soiled images, and also contributing to the wasteful consumption of the particles necessary for image formation. More specifically, as the borderline between the two areas on the object to be charged, different in surface potential level, reaches the upstream adjacencies of the nip of the moving direction of the peripheral surface of the object to be charged, the state of the particles having collected in the upstream adjacencies of the nip changes. As a result, the particles adhere to the charge roller, and move with the peripheral surface of the charge roller virtually a full turn of the charge roller. Then, they are expelled from the charge roller onto the object to be charged. Thus, as the particles are expelled from the charge roller onto the object to be charged, they form a line parallel to the lengthwise direction of the charge roller, on the object to be charged.

When a charging method employing a magnetic brush type charging device was employed, the above described expulsion of the particles by an excessive amount onto the object to be charged, the occurrence of which corresponds to the borderline between the two areas of the peripheral surface of the object to be charged, different in surface potential level, was not serious enough to create a problem. The reason why the expulsion of the particles did not create a serious problem is thought to be as follows. That is, in the case of a magnetic brush type charging apparatus, as the particles having collected in the upstream adjacencies of the nip move into the magnetic brush, they mix with the magnetic particles in the magnetic brush, being therefore prevented from being expelled by an excessive amount onto the object to be charged.

SUMMARY OF THE INVENTION

The primary object of the present invention is to provide an image forming apparatus suitable for rotating a charge roller so that its peripheral surface moves in the direction counter to the moving direction of the surface of an image bearing member, in the charging nip.

Another object of the present invention is to provide an image forming apparatus which does not form images with contaminations traceable to the expulsion of particles from the charge roller onto the image bearing member, and which also does not wastefully consume the particles necessary for image formation.

Another object of the present invention is to provide an image forming apparatus which does not form unsatisfactory images even if particles are expelled. by an excessive amount, from the charge roller onto the image bearing member.

Another object of the present invention is to provide an image forming apparatus which does not waste the particles expelled from the charge roller onto the image bearing member even if the particles are expelled by an excessive amount.

Another object of the present invention is to provide an image forming apparatus in which the excessive amount of particles expelled from the charge roller onto the image bearing member is recovered by the developing device.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

First, an image forming apparatus (1), which has a cleaner, does not counter rotate the charging member, an image forming apparatus (2), which does not have a cleaner, and does not counter rotates the charging member, and an image forming apparatus (3), which does not have a cleaner, and counter rotates the charging member, will be compared regarding the effects of the changes in the surface potential level of the image bearing member, in terms of the rotational direction of the image bearing member, upon the development process.

Next, the structures and characteristics of the image forming apparatus (1), which has a cleaner, and does not counter rotate the charging member, and the image forming apparatus (2), which does not have a cleaner, and does not counter rotate the charging member, will be described.

(1) Image forming apparatus, which has a cleaner, and in which charging member is not counter rotated, an image forming apparatus (2), which does not have a cleaner, and in which charging member is not counter rotated.

Figure 11:
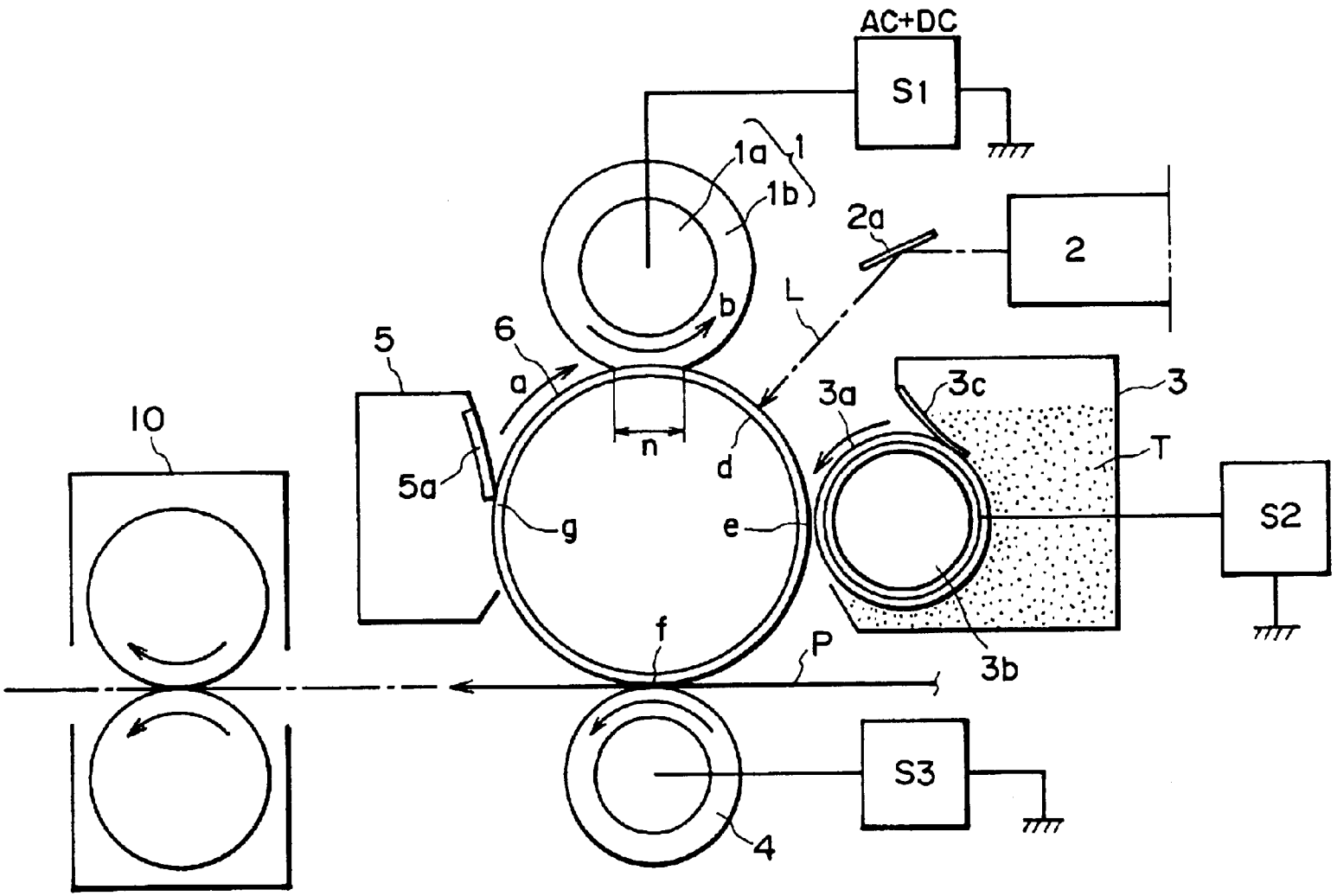
FIG. 11 is a schematic sectional view of an example of an image forming apparatus which has a cleaner, and does not counter rotate its charging member, for showing the general structure thereof.

FIG. 11 shows an example of an image forming apparatus, which has a cleaner, and in which the charging member is not counter rotated. This image forming apparatus is a laser beam printer, which employs a transfer type electrophotographic process and a reversal developing method. The charging method employed by this image forming apparatus to charge the image bearing member is an AC charging method which employs a charge roller, and in which a combination of AC and DC voltages are applied to the charge roller.

A referential numeral 6 designates an electrophotographic photoconductive member (which hereinafter will be referred to as photoconductive drum), as an image bearing member, in the form of a rotational drum. The photoconductive drum 6 is rotationally driven in the clockwise direction indicated by an arrow mark a at a predetermined peripheral velocity.

A referential numeral 1 designates a charge roller as a contact charging member, which basically comprises a metallic core 1*a,* and a layer 1*b* of electrically conductive elastic substance formed in the manner to cover the peripheral surface of the metallic core 1*a*. The charge roller 1 is kept pressed upon the photoconductive drum 6, with the application of a predetermined pressure, against the elasticity of the electrically conductive elastic layer 1*b*. Designated by a referential character n is a charging nip, which is the contact area between the peripheral surfaces of the charge roller 1 and photoconductive drum 6. The charge roller 1 is rotated by the rotation of the photoconductive drum 6 in the counterclockwise direction indicated by an arrow mark b. A referential character S1 designates a power source for applying charge bias to the charge roller 1. A predetermined charge bias, which is a combination of AC and DC voltages is applied to the charge roller 1 from this power source S1 through the metallic core 1*a*. As a result, the peripheral surface of the rotating photoconductive drum 6 is uniformly charged to predetermined polarity and potential level. In this embodiment, the peripheral surface of the photoconductive drum 6 is negatively charged to a predetermined potential level.

Designated by a referential number 2 is a laser scanner as a latent image forming means. In operation, it outputs a beam L of laser light modulated in response to image formation information in the form of sequential digital signals. This beam of laser light is projected toward the exposing station d by way of a mirror 2*a* in a manner to scan the peripheral surface of the rotating photoconductive drum 6 in the primary scanning direction. As a result, an electrostatic latent image reflecting the image formation information is formed on the peripheral surface of the rotating photoconductive drum 6. In this embodiment, the points (areas) of the developer adhesion on the peripheral surface of the rotating photoconductive drum 6 are exposed to form an electrostatic latent image reflecting the image formation information.

A referential numeral 3 stands for a developing device. In this embodiment, the developing device is a reversal developing device which uses, as developer, single-component magnetic toner T (negative toner), which becomes charged inherently to the negative polarity. A referential numeral 3*a* designates a development sleeve; 3*b,* a stationary magnetic roll in the hollow of the development sleeve 3*a;* and a referential numeral 3*c* designates a developer regulating blade. A referential character S2 designates a power source for applying development bias to the development sleeve 3*a*. The development sleeve 3*a* is rotationally driven in the counterclockwise direction indicated by the arrow mark. As the development sleeve 3*a* is rotated, the developer T is held in a certain amount to the peripheral surface of the development sleeve 3*a* by the magnetic field generated by the magnetic roll 3*b* in the development sleeve 3*a,* and moves with the peripheral surface of the development sleeve 3*a*. As this body of the developer T on the peripheral surface of the development sleeve 3*a* moves with the peripheral surface of the development sleeve 3*a,* it is regulated in thickness by the developer regulating blade 3*c*. While the body of the developer T is regulated in thickness by the developer regulating blade 3*c,* it is triboelectrically charged. Then, as the development sleeve 3*a* is further rotated, the developer on the peripheral surface of the development sleeve 3*a* is carried to the development station e, which is the area in which the development sleeve 3*a* opposes the photoconductive drum 6. In the development station e, the electrostatic latent image on the peripheral surface of the photoconductive drum 6 is developed in reverse by the developer T (developer is adhered to the exposed points (areas) of the electrostatic latent image).

Designated by a referential numeral 4 is an electrically conductive elastic transfer roller as a contact transferring member. It is in contact with the photoconductive drum 6, being kept pressed upon the photoconductive drum 6 with the application of a predetermined amount of pressure, against the elasticity of the electrically conductive elastic layer. A referential character f designates a transfer nipping portion, which is the contact area between a transfer roller 4 and photoconductive drum 6. The transfer roller 4 is rotated in the counterclockwise direction indicated by an arrow mark so that the peripheral surfaces of the transfer roller 4 and photoconductive drum 6 move in the same direction in the transfer nip. A referential character S3 stands for a power source for applying transfer bias to the transfer roller 4. A predetermined transfer bias, the polarity of which is opposite to the polarity of the developer, is applied from this power source S3 to the transfer roller 4 through the metallic core of the transfer roller 4. In this embodiment, a predetermined positive transfer bias is applied to the transfer roller 4. A transfer medium P is delivered from an unshown sheet feeding mechanism to the transfer nip f with a predetermined timing. As the transfer medium P is conveyed through the transfer nip f, remaining nipped by the transfer roller 4 and photoconductive drum 6, the developer image on the peripheral surface of the photoconductive drum 6 is electrostatically transferred onto the transfer medium P as if it were rolled out onto the transfer medium P.

After being conveyed through the transfer nip f, the transfer medium P is separated from the peripheral surface of the photoconductive drum 6, and then is introduced into a fixing device 10. In the fixing device 10, the unfixed developer image on the transfer medium P is fixed to the transfer medium P. Then, the transfer medium P is discharged as a print or copy.

After the separation of the transfer medium P, the peripheral surface of the photoconductive drum 6 is cleaned by a cleaner 5. During this cleaning process, nearly all of the substances, such as the transfer residual developer, remaining on the peripheral surface of the photoconductive drum 6, are scraped away from the peripheral surface of the photoconductive drum 6 by the cleaner 5. A referential numeral 5*a* stands for a cleaning blade in contact with the photoconductive drum 6, and a referential character g stands for the contact area (area in which photoconductive drum 6 is scraped by cleaning blade 5*a*) between the cleaning blade 5*a* and photoconductive drum 6.

Thus, virtually none of the substances capable of causing image contamination is conveyed past the cleaner 5. Therefore, the peripheral surface of the charge roller 1 is scarcely contaminated. Therefore, even if there occurs a borderline on the peripheral surface of the photoconductive drum 6, one side of which is different in potential level from the other side, the phenomenon that adhesive contaminants are expelled from the peripheral surface of the charge roller 1 onto the peripheral surface of the photoconductive drum 6 by an amount large enough to cause image contamination, does not occur.

Figure 12:
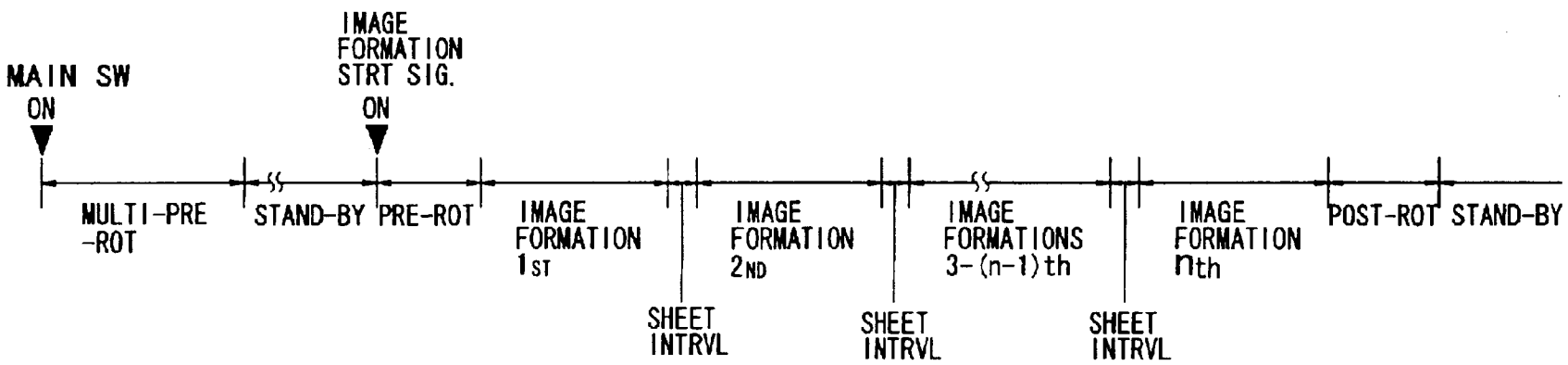
FIG. 12 is a diagram for describing the operational sequence of a typical image forming apparatus.

FIG. 12 is an operational diagram of this printer.

a) Preparatory multiple pre-rotation period

This is a period in which a printer is started up (warm-up period). As the switch of the main power source is turned on, the main motor (unshown) of the printer begins to rotates. As a result, the photoconductive drum 6 begins to be rotationally driven, and the processing devices necessary for image formation are made to carry out their preparatory operations.

b) Standby period

After the warm-up period, which lasts for a predetermined length of time, the main motor is stopped, and therefore, the photoconductive drum 6 stops being rotationally driven. Then, the printer is kept in this state (standby state) until an image formation start signal (print signal) is inputted.

c) Preparatory rotation period

This is a period in which the main motor is started again by the inputting of an image formation start signal, to begin to rotationally drive the photoconductive drum 6 again, to cause the printer to perform predetermined preparatory operations for an image forming operation power.

d) Image formation period proper

As soon as the preparatory rotation period for an image forming operation proper ends, the image forming process for forming the first print (copy) is carried out; a toner image is formed on the rotating photoconductive drum 6; the image is transferred onto a transfer medium P; the transfer medium P bearing the toner image is conveyed to the fixing device 10; the unfixed toner image is fixed to the transfer medium P; and the transfer medium P is discharged from the main assembly of the printer.

When the printer is in the continuous image formation mode, the above described image forming process is repeated until a desired number (n) of prints (copies) are outputted.

e) Paper interval period

This is a period which occurs only when the printer is in the continuous image formation mode, and which is a period from when the trailing edge of a given transfer medium P leaves the downstream edges of the transfer nip f to when the leading edge of the following transfer medium arrives at the upstream edge of the transfer nip f. In other words, it is a period in which no transfer medium P is moving through the transfer nip f.

f) Post-rotation period

This is a period which follows immediately after the completion of the process for forming the n-th print, or the last print. In this period, the main motor is kept on for a while to rotationally drive the photoconductive drum 6, and to cause the printer to carry out predetermined post-operations.

g) Standby period

This is a period following the post-rotation period. In this period, the main motor is stopped, stopping thereby the rotational driving of the photoconductive drum 6, and the printer is kept on standby until the next image formation start signal is inputted.

If an image formation signal is inputted during the multiple preparatory pre-rotation period, the image forming process is started immediately after the completion of the on-going preparatory process. Further, when forming only a single print, the printer goes through the post-rotation period after the formation of the print, and then, it enters the standby state.

Among the above listed periods, the image formation period (d) is the image formation period proper (which hereinafter will be referred to image formation period), and the multiple preparatory rotation period (a), pre-rotation period (c), paper interval (e), and post-rotation period (f) are periods in which no image is actually formed (which herein after will be referred to non-image formation period). During the post-rotation period, in order to remove the residual electrical charge from the photoconductive drum 6, only AC voltage is applied to the charge roller 1 (DC voltage is not applied), and the photoconductive drum 6 is rotated at least one full turn so that the residual electrical charge is removed by the charge roller 1.

(2) Image forming apparatus which does not have a cleaner, and does not counter rotate charging member As described before, in an image forming apparatus with no cleaner, the transfer residual substances (transfer residual toner) directly enter the charging device. Therefore, the transfer residual substances are more likely to adhere to the charging member, contaminating the charging member, in an image forming apparatus with no cleaner, than in an image forming apparatus with a cleaner. The transfer residual substances are recovered, or reused, by the developing device. Without a cleaner, the charging device is contaminated with the transfer residual substances. As the charging device becomes contaminated with the transfer residual substances, the transfer residual substances transfer onto the developing device and/or transfer station, resulting in the further image contamination. In order to minimize the contamination, it is necessary to keep the entirety of the image forming apparatus clean.

Figure 13:
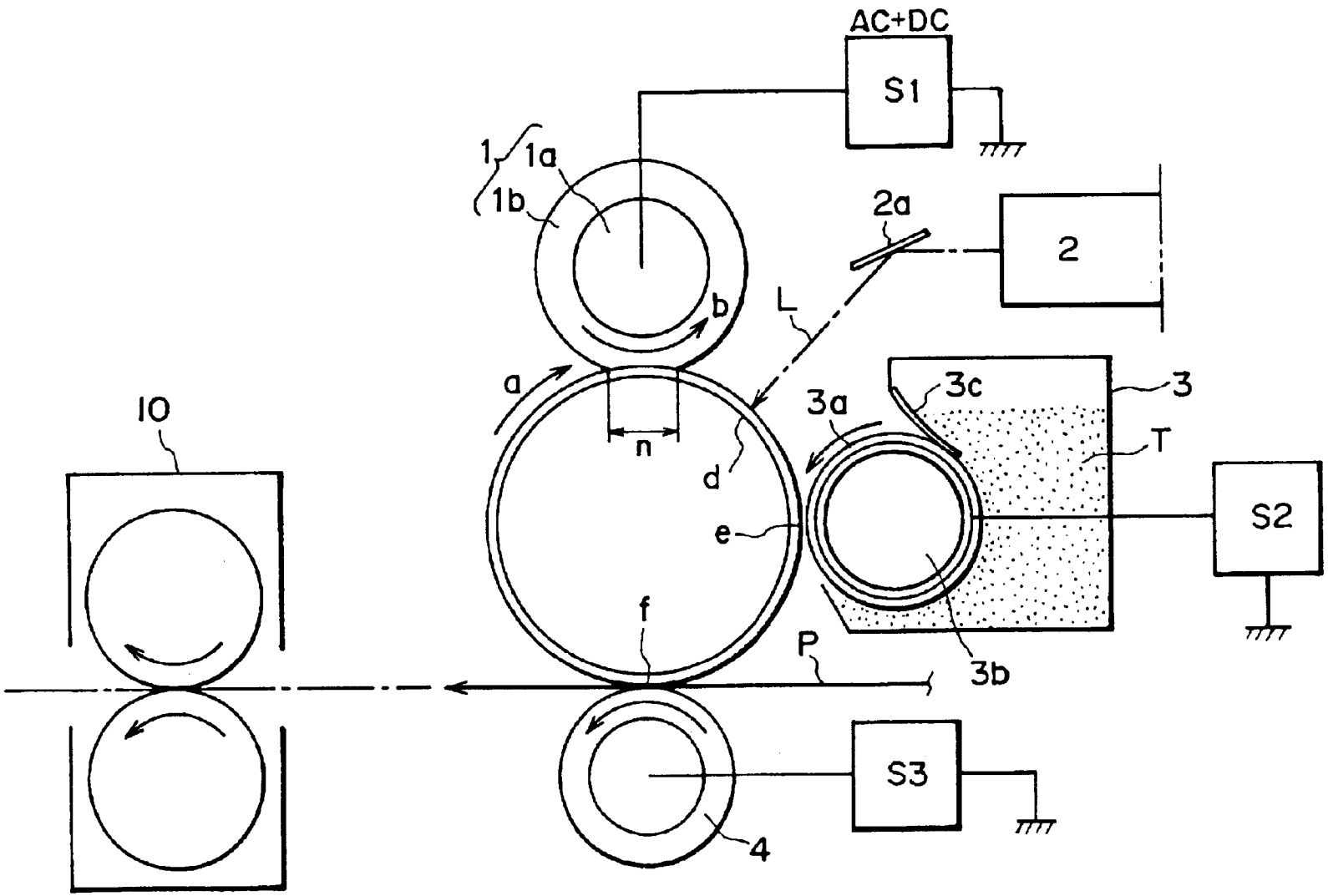
FIG. 13 is a schematic sectional view of an example of an image forming apparatus which does not have a cleaner, and does not counter rotate its charging member, for showing the general structure thereof.

FIG. 13 shows an example of an image forming apparatus which has no cleaner, and which does not counter rotate the charging member. This image forming apparatus equates to the printer shown in FIG. 11, minus the cleaner 5. Otherwise, this image forming apparatus is the same in structure as the printer shown in FIG. 11. Therefore, its structure will not be described.

Next, it will be described that the transfer residual substances (transfer residual toner, etc.) remaining on the charge roller 1 are changed in polarity, as shown in Table 1, by the relationship in terms of magnitude between the DC voltage $V_1$ applied to the metallic core 1*a* of the charge roller 1, and the surface potential level of the photoconductive drum 6, in the downstream adjacencies of the charging nip.

Figure 14:
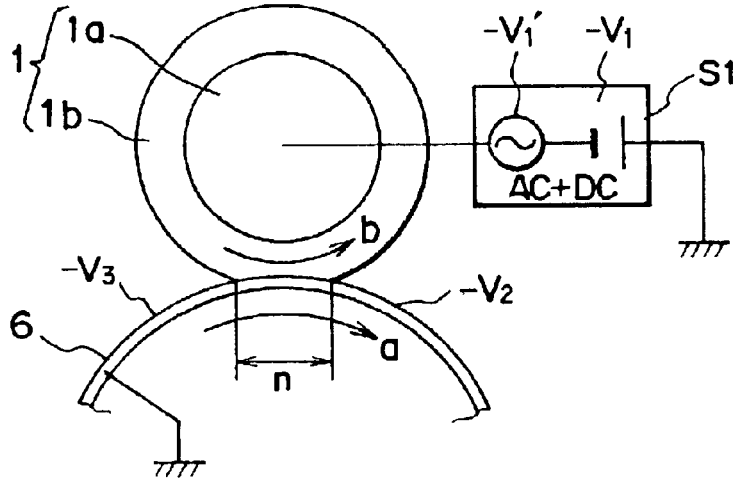
FIG. 14 is a schematic sectional view of the charging station, and its adjacencies, of an image forming apparatus which does not have a cleaner, and does not counter rotates its charging member, for pictorially defining the surface potential level of the charging roller, and the surface potential level of the photoconductive drum, in the upstream and downstream adjacencies of the charging nip.

Referring to FIG. 14:

I. $-V_1[V](V_1 \geqq 0)$: DC voltage applied to the metallic core 1*a* of the charge roller 1*a;*

II. $V_{1'}[V](V_{1'} \geqq 0)$: AC voltage applied to the metallic core 1*a* of the charge roller 1*a;*

III. $-V_2[V](V_2 \geqq 0)$: surface potential level of the photoconductive drum 6, in the downstream adjacencies of the charging nip; and IV. $-V_3[V](V_3 \geqq 0)$: surface potential level of the photoconductive drum 6, in the upstream adjacencies of the charging nip.

The two cases which occur during an image forming operation, and characterize this printer, will be described.

Figure 15:
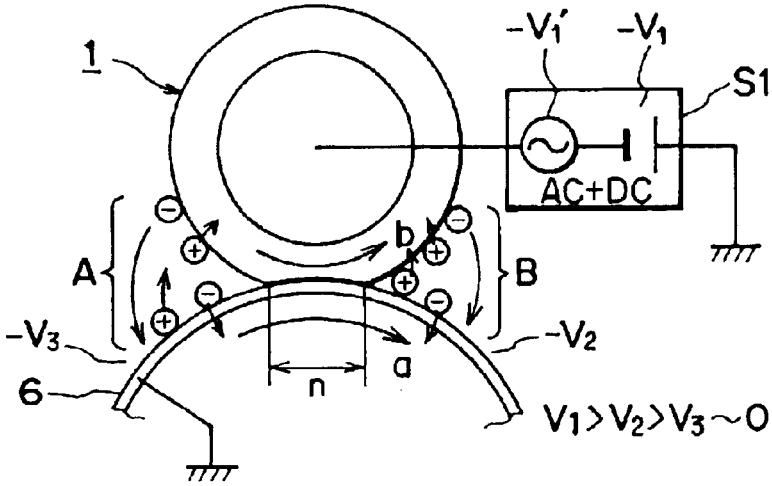
FIG. 15 is a schematic sectional view of the charging nip, and its adjacencies, of an image forming apparatus which does not have a cleaner, and does not counter rotates its charging member, for showing the behavior of the particles in the charging nip, during the first charging rotation of the photoconductive drum.

Case 1: first rotation of photoconductive drum after starting of charging of photoconductive drum (FIG. 15)

In this case, $V_1>V_2>V_3=0$ [V]. In other words, in case state, before the photoconductive drum 6 begins to be charged, the surface potential level of the photoconductive drum 6 is 0 V, and therefore, $V_3=0$ V.

Figure 16:
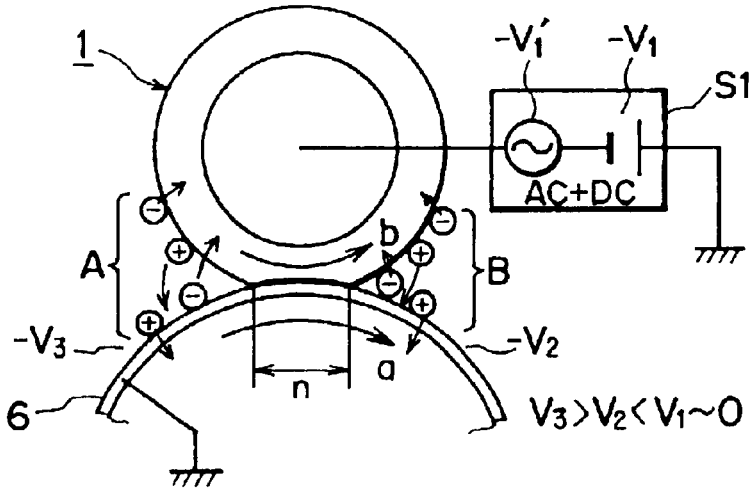
FIG. 16 is also a schematic sectional view of the charge nip, and its adjacencies, of an image forming apparatus which does not have a cleaner, and does not counter rotates its charging member, for showing the behavior of the particles in the charging nip, during the first charge removal rotation of the photoconductive drum.

Case 2: first charge removal rotation of photoconductive drum (FIG. 16)

In this case, $V_3>V_2>V_1=0$ [V]. The photoconductive drum 6 is cleared of electrical charge by the charge roller 1 to which AC voltage is being applied, without the application of DC voltage. Therefore, $V_1=0$ V.

In Case 1, in the upstream adjacencies of the charging nip, in terms of the rotational direction of the photoconductive drum 6 (Area A in FIG. 15), the positively charged particles, for example, the positively charged developer particles, move onto the charge roller 1, whereas the negatively charged particles, for example, the negatively charged developer particles, remain on the photoconductive drum 6. In the downstream adjacencies of the charging nip, in terms of the rotational direction of the photoconductive drum 6 (Area B in FIG. 15), the positively charged particles remain on the charge roller 1, whereas the negatively charged particles remain on the photoconductive drum 6.

Thus, after passing the charging nip, the positively charged particles move onto the charge roller 1, whereas the negatively charged particles remain on the photoconductive drum 6.

In Case 2, in the upstream adjacencies of the charging nip (Area A in FIG. 16), the positively charged particles remain on the photoconductive drum 6, whereas the negatively charged particles move onto the charge roller 1. In the downstream adjacencies of the charging nip, in terms of the rotational direction of the photoconductive drum 6 (Area B in FIG. 16), the positively charged particles remain on the photoconductive drum 6, whereas the negatively charged particles remain on the charge roller 1.

Thus, after passing through the charging nip, the positively charged particles remain on the photoconductive drum 6, whereas the negatively charged particles move onto the charge roller 1.

Even in the cases other than Cases 1 and 2, the positively charged particles adhere to the charge roller 1 as long as $V_2<V_1$, whereas the negatively charged particles adhere to the charge roller 1 as long as $V_2>V_1$.

TABLE 1

| > or < | POLARITIES |
|---|---|
| $v_1 > v_2$ | N |
| $v_1 > v_2$ | P |

Next, the recovery or reuse of the transfer residual substances by the developing device, that is, one of the important subjects concerning an image forming apparatus with no cleaner, will be discussed while taking into consideration the inherent behaviors of the transfer residual substances in the charging nip, which were described with reference to the two cases: Cases 1 and 2.

As the voltage $-V_1[V](V_1>0)$ is applied to the charge roller 1, the positively charged particles adhere to the charge roller 1. However, when $V_1=0$, for example, during the period in which electrical charge is removed from the photoconductive drum 6, they are expelled from the charge roller 1 onto the photoconductive drum 6. Thus, during the first charge removal rotation of the photoconductive drum 6, the development bias for recovering the positively charged particles by the developing device 3 must be applied.

On the other hand, while Voltage $-V_1[V](V_1>0)$ is applied to the charge roller 1, the negatively charged particles pass through the charging nip. Therefore, while Voltage $-V_1[V](V_1>0)$ is applied to the charge roller 1, the development bias must be applied to continually recover or reuse them, by the developing device 3. During the charge removal period, they adhere to the charge roller 1. Therefore, during the first rotation of the photoconductive drum 6 in the multiple preparatory post-rotation period for forming the next image after the removal of the residual electrical charge resulting from the preceding image formation, from the photoconductive drum 6, the negatively charged particles are expelled from the charge roller 1 onto the photoconductive drum 6. Thus, during this first charge removal rotation of the photoconductive drum 6, the development bias for recovering them by the developing device is applied.

To summarize the above description, while DC voltage is applied to the charge roller 1 as a contact charging member, the positively charged particles adhere to the charge roller 1, whereas while DC voltage is not applied to the charge roller 1, the negatively charged particles adhere to the charge roller 1. The particles adhere evenly across the entirety of the peripheral surface of the charge roller 1. Thus, in order to expel from the charge roller 1 most of the positively or negatively charged particles resulting from the changes in the charge bias, it is necessary for the charge roller 1 to completely rotate once. The period in which the particles are expelled is the period starting from the moment the DC voltage applied to the charge roller 1 is switched, to the moment the first complete rotation of the charge roller 1 ends after the switching of the DC voltage.

As described before, a substantial number of injection charging methods, which charge the surface of an object to be charged, by directly injecting electrical charge into the object from a contact charging member, adopt a structure in which a velocity difference is provided between the contact charging member and object to be charged. Further, it is desired that a contact charging member is counter rotated relative to an object to be charged, in order to realize satisfactory state of contact between contact charging member and object.

Next, the behavior of the transfer residual substances, which characterizes this embodiment of an image forming apparatus (3), which does not have a cleaner and counter rotates the charging member, will be described in comparison to that in a conventional image forming apparatus.

First, an image forming apparatus equipped with an exposing apparatus for exposing the points (areas) of toner adhesion on the peripheral surface of the photoconductive drum 6 (points or areas on peripheral surface of photoconductive member, to which toner is adhered), will be described.

Figure 17:
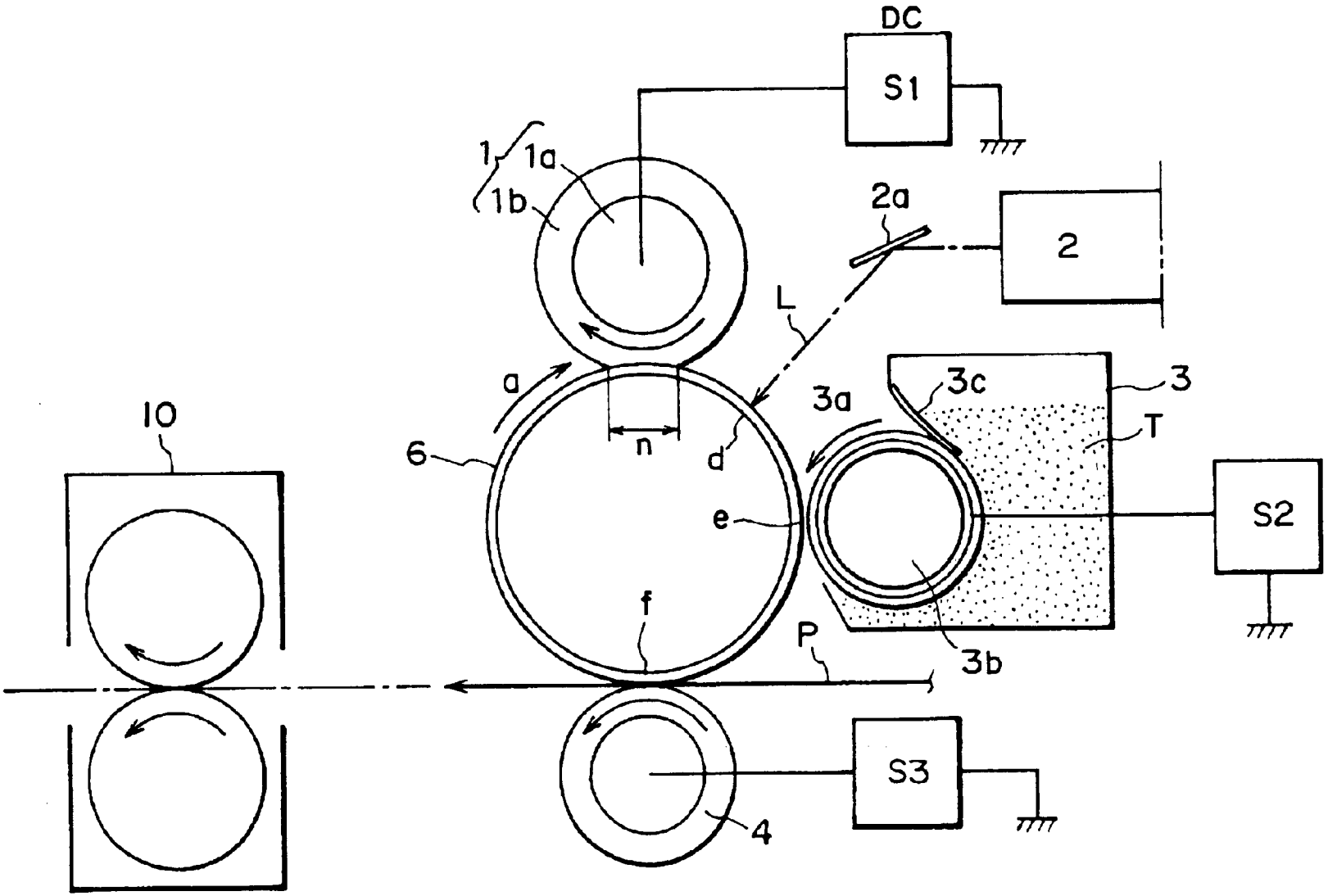
FIG. 17 is a schematic sectional view of an example of an image forming apparatus which does not have a cleaner, counter rotates its charging member, and has an exposing apparatus for exposing the points (areas) of developer adhesion, for showing the structure thereof.

FIG. 17 shows an example of an image forming apparatus, which has no cleaner, counter rotates the charging member, and has an exposing apparatus for exposing the points (areas) of toner adhesion.

This image forming apparatus is similar to the cleanerless printer shown in FIG. 13, except that the method employed by the printer in FIG. 13 to charge the photoconductive drum is replaced with a direction injection charging method in which charge roller 1 is counter rotated relative to the photoconductive drum 6. The charge roller 1 has a deformable elastic layer, and is capable of holding positively charged electrically conductive particles, for example. Therefore, the electrically conductive particles fill the gap between the minute gaps between the peripheral surfaces of the charge roller 1 and photoconductive drum 6, in the charging nip, improving the efficiency with which electrical charge is injected into the photoconductive drum 6. From the standpoint of filling the minute gaps between the peripheral surfaces of the charge roller 1 and photoconductive drum 6, in the charging nip, the electrically conductive particles are desired to be as small as possible in particle diameter. However, the sizes of the electrically conductive particles are desired to be smaller than the picture element size of an electrostatic latent image. Further, the electrically conductive particles are desired to be no more than $1\times10^{12}$ (Ω·cm) in resistance value, preferably, no more than $1\times10^{10}$ (Ω·cm). Since the electrically conductive particles on the charge roller 1 gradually move onto the photoconductive drum 6, the amount of the electrically conductive particles in the charging nip gradually reduces. Thus, the electrically conductive particles are mixed into the developer in the developing device so that the electrically conductive particles in the developing device are supplied to the charging nip by way of the photoconductive drum 6. The structures of this printer (3) are the same as those of the printers (1) and (2). Therefore, they will not be described to avoid the repetition of the same description.

The charge roller is rotationally driven in the clockwise direction indicated by an arrow mark c at a predetermined peripheral velocity. Thus, the charge roller 1 counter rotates relative to the photoconductive drum 6, in the charging nip n, that is, the contact area between the charge roller 1 and photoconductive drum 6, with the presence of a predetermined amount of peripheral velocity difference between the charge roller 1 and photoconductive drum 6, while rubbing the peripheral surface of the photoconductive drum 6. As the charge roller 1 is rotated, a predetermined DC voltage (DC charging method) is applied to the charge roller 1 from the charge bias application power source S1 through the metallic core 1*a*. As a result, the photoconductive drum 6 becomes charged primarily through the charge injection mechanism. Also in this embodiment, the photoconductive drum 6 is charged to the negative polarity, and the normal polarity to which the developer becomes charged is negative.

Next, the behavior of the transfer residual substances in this image forming apparatus will be discussed. There are five distinctive periods during the image forming operation carried out by this apparatus. The polarity of the transfer residual substances which stagnate in the upstream adjacencies of the charging nip changes in response to the relationship among $V_1$, $V_2$, and $V_3$, as shown in Table 2, wherein:

$V_1$: DC voltage applied to the metallic core 1*a* of the charge roller 1

$V_2$: surface potential level of the photoconductive drum 6 on the downstream side of the charging nip $V_3$: surface potential level of the photoconductive drum 6 on the upstream side of the charging nip.

The values of the surface potential levels $V_1$, $V_2$, and $V_3$ of the photoconductive drum used in this image forming apparatus are all greater than 0.

Figure 18:
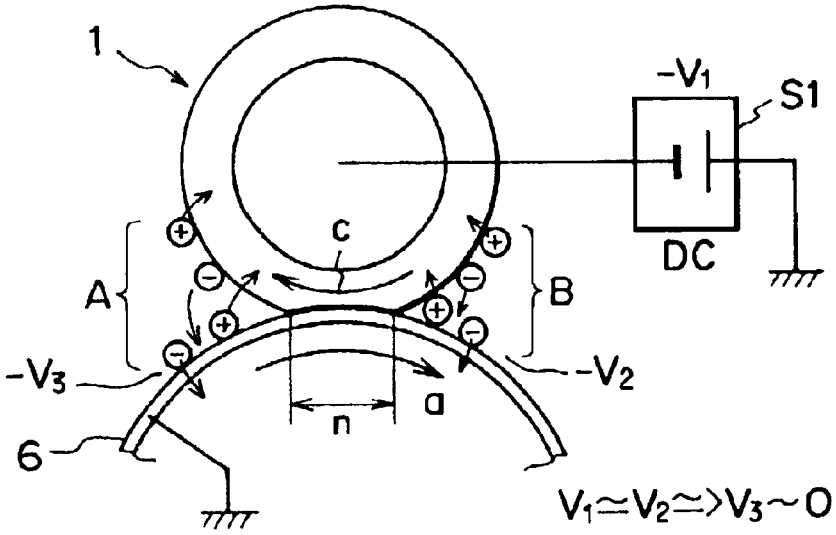
FIG. 18 is a schematic sectional view of the charging nip, and its adjacencies, of an example of an image forming apparatus which does not have a cleaner, counter rotates its charging member, and has an exposing apparatus for exposing the points (areas) of developer adhesion, for showing the behavior of the particles in the adjacencies of the charging nip during the first charging rotation of the photoconductive drum.
Figure 19:
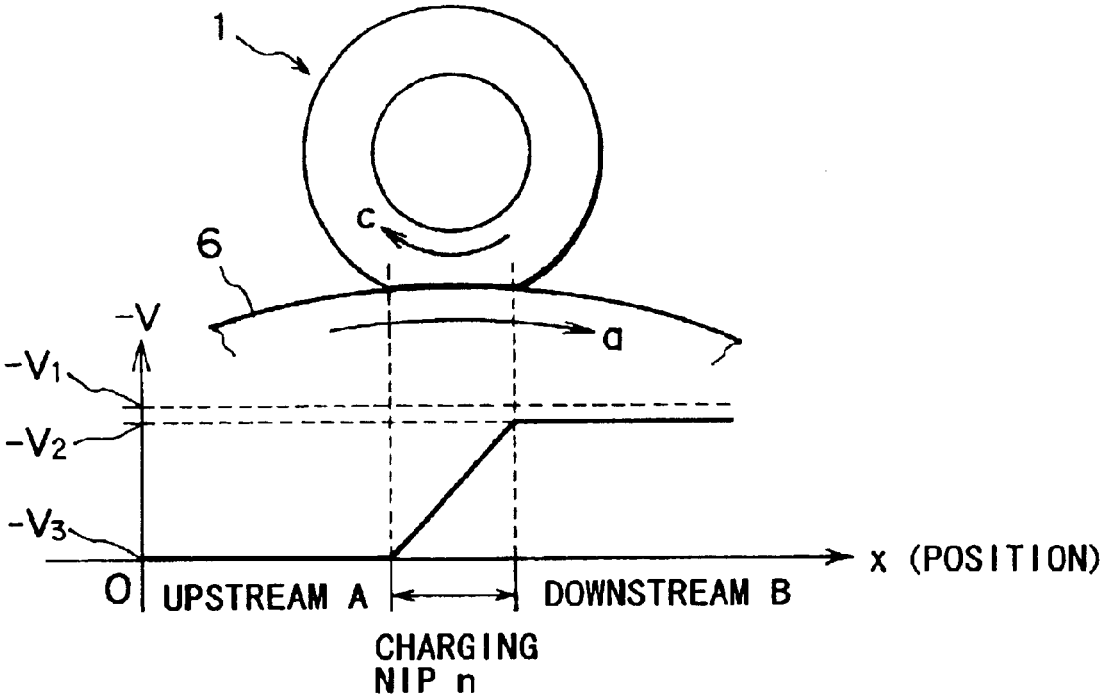
FIG. 19 is a schematic sectional view of the charging nip, and its adjacencies, of an example of an image forming apparatus which does not have a cleaner, counter rotates its charging member, and has an exposing apparatus for exposing the points (areas) of developer adhesion, for showing the surface potential level of the photoconductive drum, in the adjacencies of the charging nip, during the first charging rotation of the photoconductive drum.

Case 1: first photoconductive drum charging rotation (FIGS. 18 and 19)

In this stage, $V_1 \approx V_2 > V_3 \approx 0$ [V], as shown in FIG. 19. $V_3$ corresponds to the portion of the peripheral surface of the photoconductive drum 6, which has not been charged, and therefore, its value is approximately 0. In this embodiment, an injection charging method is in use. Therefore, the potential level of the voltage applied to the charge roller is approximately equal to the potential level to which the peripheral surface of the photoconductive drum is charged by the charge roller.

Figure 20:
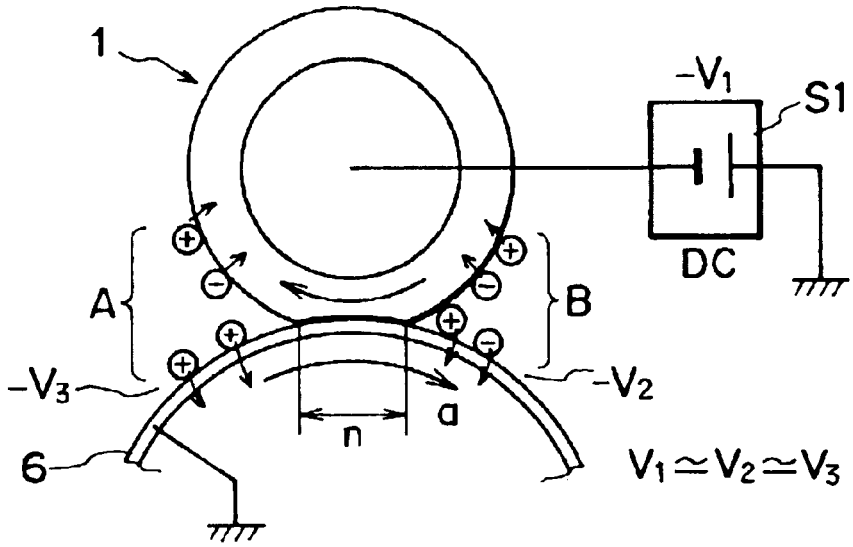
FIG. 20 is a schematic sectional view of the charging nip, and its adjacencies, of an example of an image forming apparatus which does not have a cleaner, counter rotates its charging member, and has an exposing apparatus for exposing the points (areas) of developer adhesion, for showing the behavior of the particles in the adjacencies of the charging nip while the photoconductive drum is charged and at the same time the solid white area of an image is printed.
Figure 21:
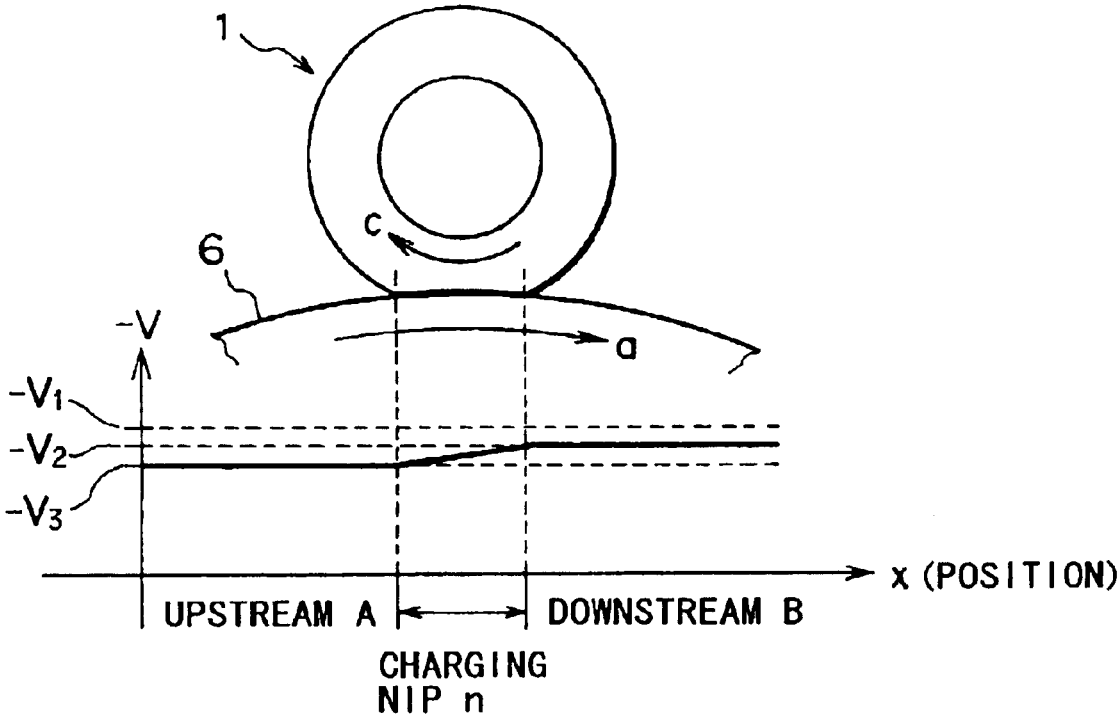
FIG. 21 is a schematic sectional view of the charging nip, and its adjacencies, of an example of an image forming apparatus which does not have a cleaner, counter rotates its charging member, and has an exposing apparatus for exposing the points (areas) of developer adhesion, for showing the behavior of the particles in the adjacencies of the charging nip while the photoconductive drum is charged and at the same time the solid white area of an image is printed.

Case 2: period in which solid white portion of image is printed while photoconductive drum is charged (FIGS. 20 and 21)

In this case, $V_1 \approx V_2 \approx V_3$ 0 [V], as shown in FIG. 20. The solid white portion printing means a process in which the peripheral surface of the photoconductive drum is not exposed at all by the laser scanner, and therefore, no toner adheres to the peripheral surface of the photoconductive drum during the development period. Since the photoconductive drum is not exposed at all by the laser scanner, the surface potential level of the entirety of the peripheral surface of the photoconductive drum remains virtually the same as the potential level to which it was charged by the charge roller.

Figure 22:
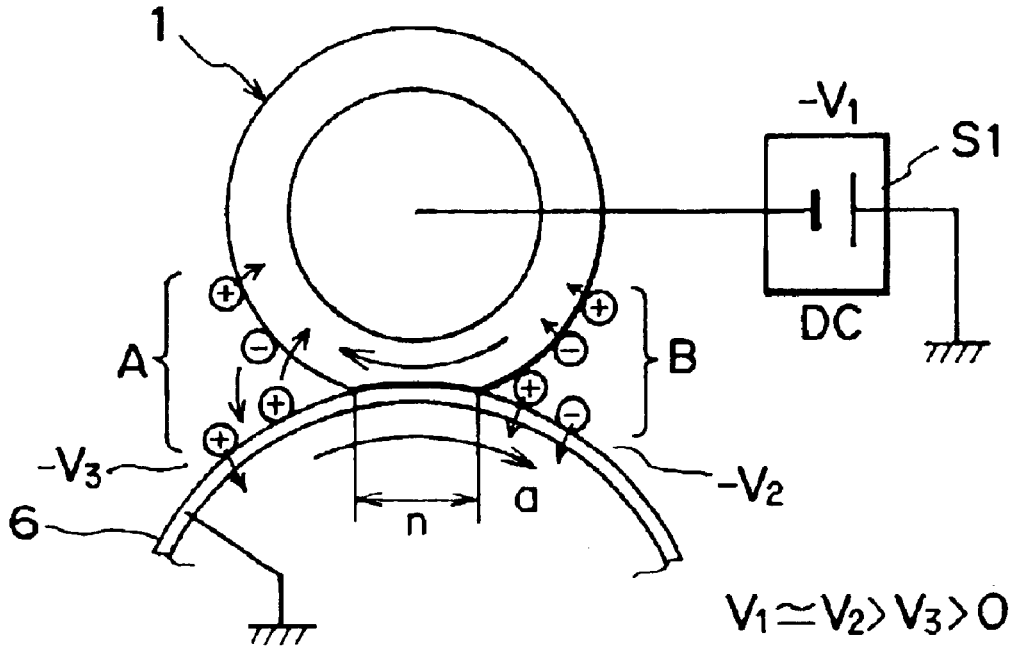
FIG. 22 is a schematic sectional view of the charging nip, and its adjacencies, of an example of an image forming apparatus which does not have a cleaner, counter rotates its charging member, and has an exposing apparatus for exposing the points (areas) of developer adhesion, for showing the behavior of the particles in the adjacencies of the charging nip while the photoconductive drum is charged and at the same time the solid black area of an image is printed.

Case 3: period in which solid white portion of image is printed while photoconductive drum is charged (FIG. 22)

In this case, $V_1 \approx V_2 > V_3 > 0$ [V], which is approximately the same as the relationship shown in FIG. 19. The solid black printing means a process in which the entirety of the peripheral surface of the photoconductive drum is exposed by the laser scanner, and therefore, toner adheres to the entirety of the peripheral surface of the photoconductive drum during the development period. Since the entirety of the peripheral surface of the photoconductive drum is exposed by the laser scanner, the surface potential level of the entirety of the peripheral surface of the photoconductive drum after exposure is close to 0 V.

Figure 23:
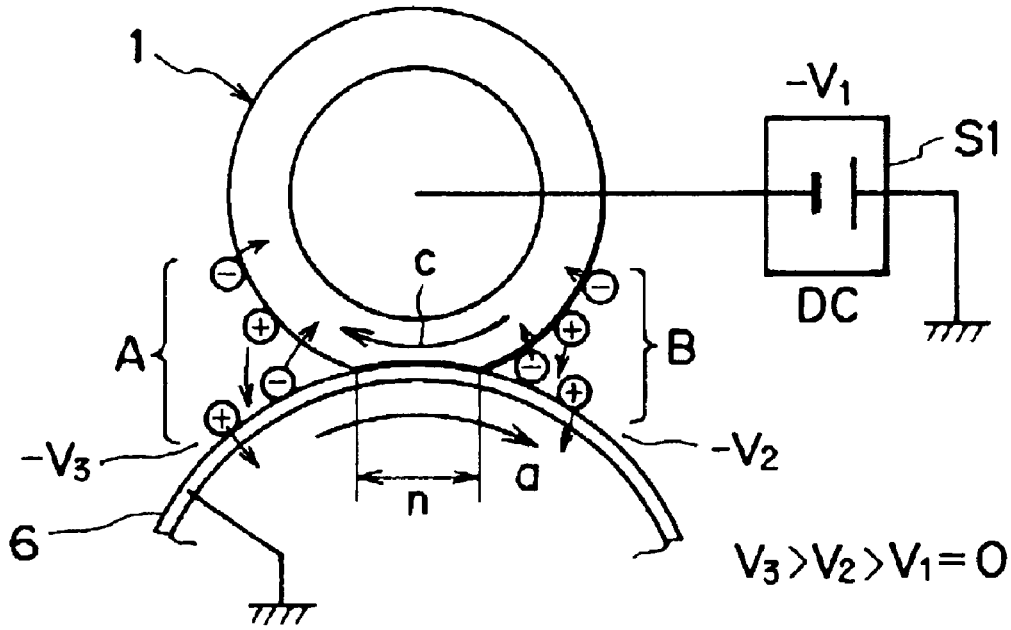
FIG. 23 is a schematic sectional view of the charging nip, and its adjacencies, of an example of an image forming apparatus which does not have a cleaner, counter rotates its charging member, and has an exposing apparatus for exposing the points (areas) of developer adhesion, for showing the behavior of the particles in the adjacencies of the charging nip during the first charge removal rotation of the photoconductive drum.
Figure 24:
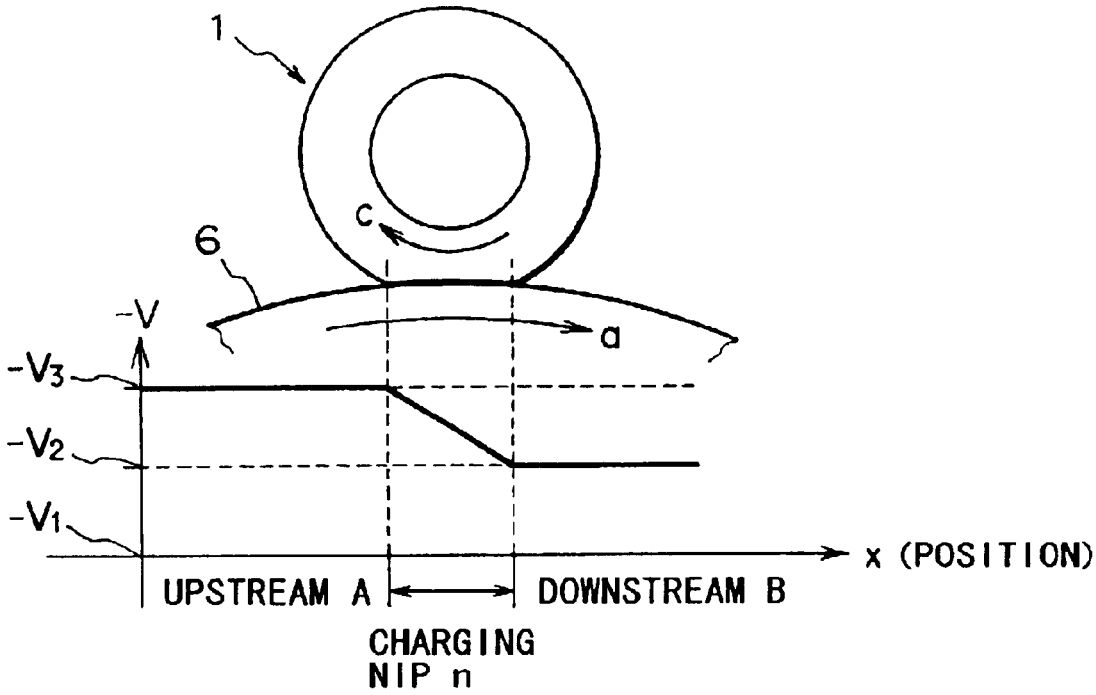
FIG. 24 is a schematic sectional view of the charging nip, and its adjacencies, of an example of an image forming apparatus which does not have a cleaner, counter rotates its charging member, and has an exposing apparatus for exposing the points (areas) of developer adhesion, for showing the behavior of the particles in the adjacencies of the charging nip during the first charge removal rotation of the photoconductive drum.

Case 4: first charge removal rotation of photoconductive drum (FIGS. 23 and 24)

In this case, $V_3 > V_2 > V_1 = 0$ [V], as shown in FIG. 24. Since 0 V is applied to the charge roller during the charge removal rotation of the photoconductive drum, the surface potential level of the photoconductive drum after the charge removal is $V_2$[V].

Figure 25:
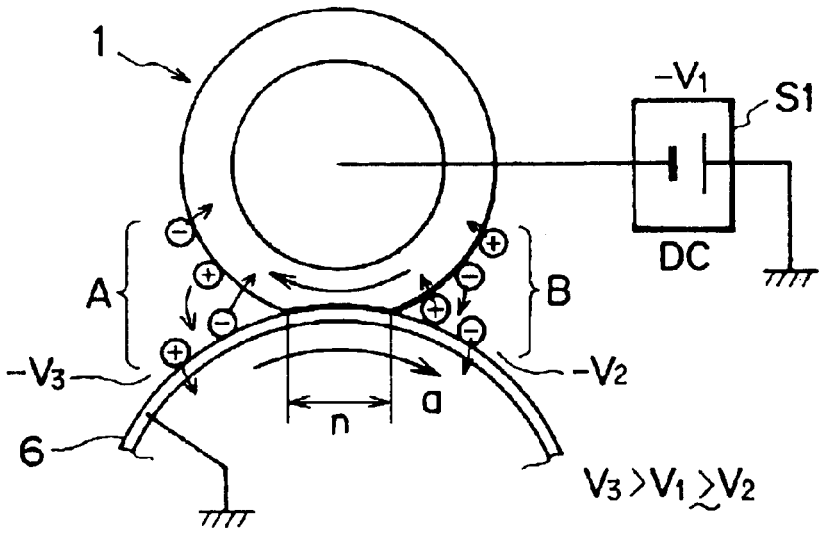
FIG. 25 is a schematic sectional view of the charging nip, and its adjacencies, of an example of an image forming apparatus which does not have a cleaner, counter rotates its charging member, and has an exposing apparatus for exposing the points (areas) of developer adhesion, for showing the behavior of the particles in the adjacencies of the charging nip while the photoconductive drum is charged and at the same time, negative voltage is applied to the transfer station.
Figure 26:
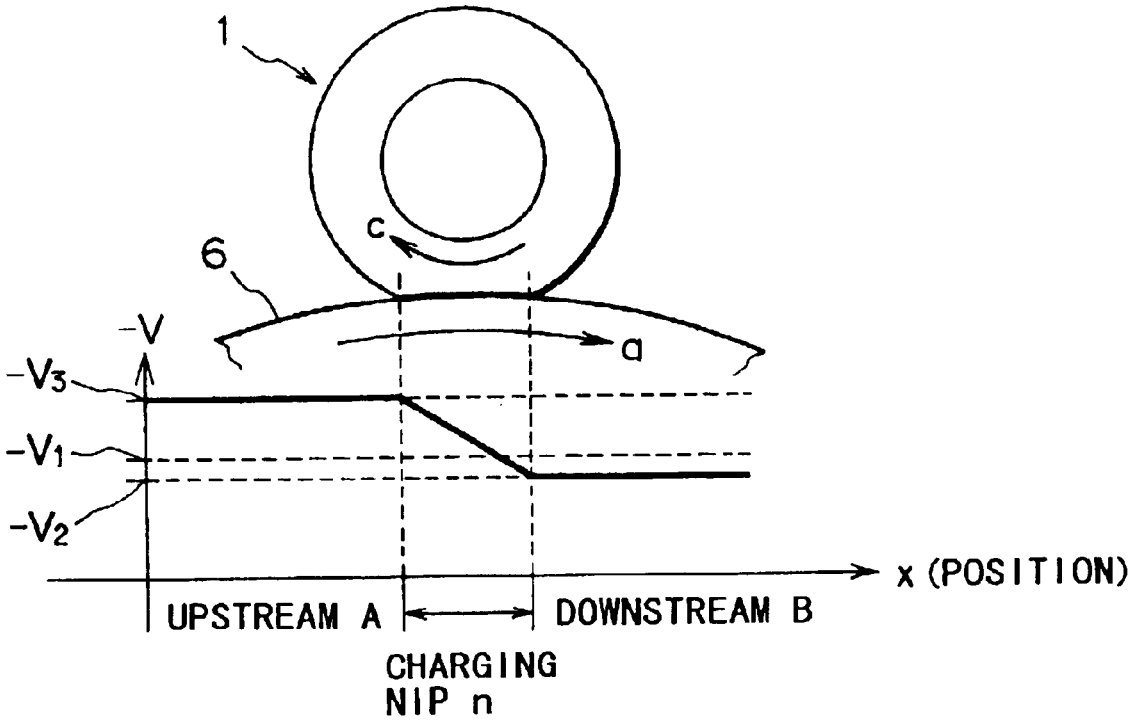
FIG. 26 is a schematic sectional view of the charging nip, and its adjacencies, of an example of an image forming apparatus which does not have a cleaner, counter rotates its charging member, and has an exposing apparatus for exposing the points (areas) of developer adhesion, for showing the behavior of the particles in the adjacencies of the charging nip while the photoconductive drum is charged and at the same time, negative voltage is applied to the transfer station.

Case 5: period in which negative voltage is applied to transfer station while photoconductive drum is charged (FIGS. 25 and 26)

In this case, $V_3 > V_1 \approx V_2$, as shown in FIG. 26. When negative voltage is applied to the transfer roller 4 is when the negatively charged toner adhering to the transfer roller 4 must be returned to the photoconductive drum. As the negative voltage is applied to the transfer roller 4, such an electric field that moves the negatively charged toner on the transfer roller 4 onto the photoconductive drum is generated. As a result, the transfer roller 4 is cleaned.

Figure 1:
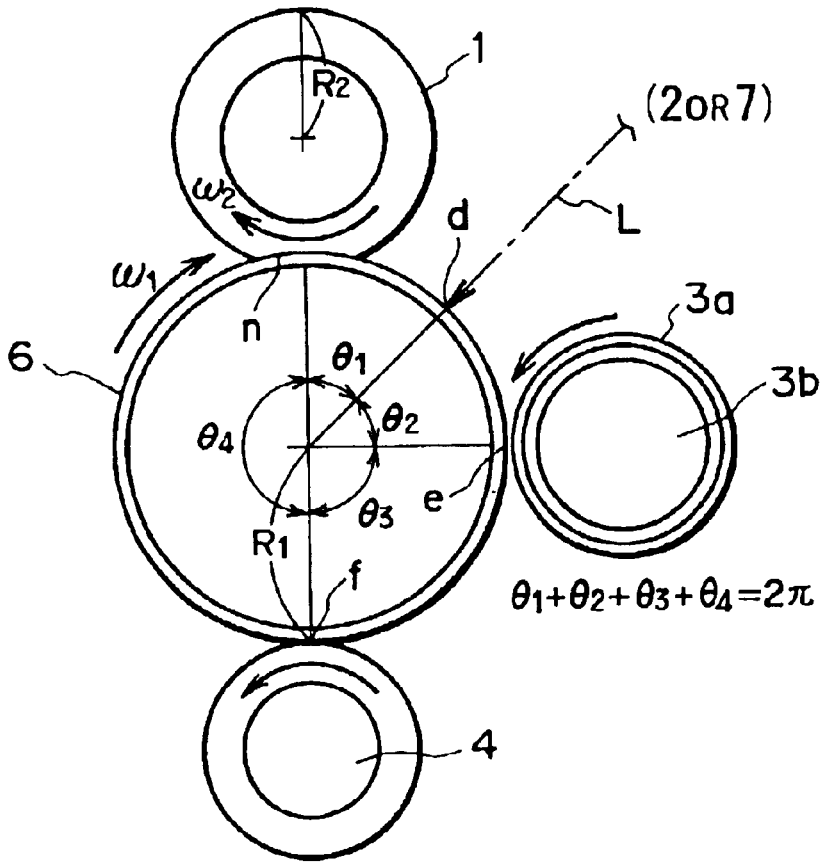
FIG. 1 is a schematic sectional view of an image forming apparatus, which does not have a cleaner, and counter rotates its charging member, for showing the general structure thereof.

Referring to FIG. 1, in Case 1), $V_1 > V_3$. Since $V_3$ stands for the potential level of the uncharged point, $V_3 \approx 0$ [V]. Thus, in the upstream adjacencies (Area A in FIG. 18) of the charging nip in terms of the rotational direction of the photoconductive drum, the positively charged particles, such as developer particles or electrically conductive charging performance enhancement particles, move from the photoconductive drum 6 onto the charge roller 1, and remain on the charge roller 1 while the charge roller 1 rotates approximately once. In the downstream adjacencies (Area B in FIG. 18) of the charging nip in terms of the rotational direction of the photoconductive drum, $V_1 \approx V_2$. Therefore, the positively charged particles on the peripheral surface of the charge roller 1 are expelled onto the photoconductive drum 6.

In comparison, in the upstream adjacencies of the charging nip, the negatively charged particles, such as negatively charged developer particles, remain on the photoconductive drum 6, and then, are mechanically removed (scraped away) in the charging nip. However, $V_1 > V_3$. Therefore, they return to the photoconductive drum 6. Thus, the negatively charged particles stagnate in the upstream adjacencies of the charging nip.

As the photoconductive drum begins its second charging rotation, a borderline, one side of which is different in potential level from the other side in terms of the rotational direction of the photoconductive drum, is created on the peripheral surface of the photoconductive drum, at the line which corresponds to the end of the first rotation, that is, the beginning of the second rotation. This borderline frees the negatively charged particles stagnating in the upstream adjacencies of the charging nip. The freed negatively charged particles are temporarily held on the peripheral surface of the charge roller 1, and remain thereon while the charge roller 1 rotates approximately once. Then, they are expelled onto the photoconductive drum 6 by an excessive amount, which effects a linear image contamination.

In Case 2), in the upstream adjacencies of the charging nip (Area A in FIG. 20), $V_1 \approx V_3$. Therefore, both the positively charged particles and negatively charged particles remain on the photoconductive drum 6.

In the charging nip, the transfer residual substances on the photoconductive drum 6 are mechanically moved (scraped) onto the charge roller 1. Then, they remain adhered to the peripheral surface of the charge roller 1 while the charge roller 1 rotates approximately once.

In the downstream adjacencies of the charging nip (Area B in FIG. 20), $V_1 \approx V_2$. Therefore, both the positively charged particles and negatively charged particles are expelled from the peripheral surface of the charge roller 1 onto the photoconductive drum 6. If they are expelled by an excessive amount onto the photoconductive drum 6, they sometimes interfere with the exposing process for the formation of an electrostatic latent image. After being expelled onto the photoconductive drum 6, they are to be recovered by developing device 3. However, some of them pass the developing device 3, and appear as the fog across the solid white areas of an image.

In Case 3), $V_1 > V_3$. Further, the value of $V_3$ is approximately equal to that of the potential level of the exposed point of the peripheral surface of the photoconductive drum (which hereinafter will be referred to as "illuminated point potential level").

In the upstream adjacencies (Area A in FIG. 22) of the charging nip, the positively charged particles move from the photoconductive drum 6 onto the charge roller 1, and remain on the charge roller 1 while the charge roller 1 rotates approximately once. In the downstream adjacencies (Area B in FIG. 20) of the charging nip, $V_1 \approx V_2$. Therefore, the positively charged particles are expelled from the peripheral surface of the charge roller 1 onto the photoconductive drum 6.

In comparison, in the upstream adjacencies of the charging nip, the negatively charged particles remain on the photoconductive drum 6, and then, are mechanically removed (scraped away) in the charging nip. However, $V_1 > V_3$. Therefore, they return to the photoconductive drum 6. Thus, the negatively charged particles stagnate in the upstream adjacencies of the charging nip.

As the borderline between a solid black area and a solid white area of an image is formed when the image forming apparatus is in the above described state, a borderline, one side of which is different in potential level from the other side in terms of the rotational direction of the photoconductive drum, is created on the peripheral surface of the photoconductive drum. This borderline frees the negatively charged particles stagnating in the upstream adjacencies of the charging nip. The freed negatively charged particles are held on the peripheral surface of the charge roller 1, and remain thereon while the charge roller 1 rotates approximately once. Then, they are expelled onto the photoconductive drum 6 by an excessive amount, which effects a linear image contamination.

In Case 4), that is, during the first discharging rotation of the photoconductive drum (when $V_1$ is reduced to 0 V), $V_3>V_2>V_1=0$ [V], and $|V_3-V_1|$ during the first drum rotation>$|V_3-V_1|$ during the second drum rotation.

Therefore, in the upstream adjacencies (Area A in FIG. 23) of the charging nip, the positively charged particles remain on the photoconductive drum 6, and then, are mechanically moved (scraped away) onto the charge roller 1 in the charging nip. However, $V_3>V_1=0$[V]. Therefore, they return to the photoconductive drum 6. In other words, the positively charged particles stagnate in the upstream adjacencies of the charging nip.

In comparison, in the upstream adjacencies of the charging nip, the negatively charged particles move from the photoconductive drum 6 onto the charge roller 1. Then, they remain held on the charge roller 1, while the charge roller 1 is rotated approximately once.

In the downstream adjacencies of the charging nip (Area B in FIG. 23), $V_2>V_1=0$[V]. Therefore, even if the negatively charged particles are expelled from the charge roller 1 onto the photoconductive drum 6, they move back onto the charge roller 1. In other words, the negatively charged particles remain held on the peripheral surface of the charge roller 1.

As the photoconductive drum begins its second discharging rotation, a borderline, one side of which is different in potential level from the other side in terms of the rotational direction of the photoconductive drum, is created on the peripheral surface of the photoconductive drum, at the line which corresponds to the end of the first rotation, that is, the beginning of the second rotation. This borderline frees some of the negatively charged particles stagnating in the upstream adjacencies of the charging nip. The freed negatively charged particles are temporarily held on the peripheral surface of the charge roller 1, and remain thereon while the charge roller 1 rotates approximately once. Then, they are expelled onto the photoconductive drum 6 by an excessive amount, which effects a linear image contamination.

A phenomenon similar to the above described one also occurs at the borderline on the peripheral surface of the photoconductive drum 6, which corresponds to the end of the second discharging rotation (which is the beginning of the third rotation), the end of the third drum rotation (which is the beginning of the fourth drum rotation), . . . , although each phenomenon is different from the other in the amount of the particles expelled from the charge roller 1 onto the photoconductive drum 6.

In the case that positively charged particles (for example, external additive added to developer) play an essential role in image formation, it is necessary to recover and reuse the positively charged particles.

In Case 5), that is, while the photoconductive drum is charged; the negative voltage is charged to the transfer station; and no image is formed, the particles behavior is as follows.

The photoconductive drum is charged to the negative polarity, in the transfer station. Therefore, the relationship among $V_1$, $V_2$, and $V_3$ becomes: $V_3>V_1\approx V_2$.

Thus, in the upstream adjacencies (Area A in FIG. 25) of the charging nip, the positively charged particles remain on the photoconductive drum 6. Then, they are mechanically moved (scraped away) from the photoconductive drum 6 onto the charge roller 1, in the charging nip. However, $V_3>V_1$. Therefore, they return to the photoconductive drum 6. In other words, the positively charged particles stagnate in the upstream adjacencies of the charging nip.

In comparison, in the upstream adjacencies of the charging nip, the negatively charged particles move from the photoconductive drum 6 onto the charge roller 1, and remain held on the charge roller 1 while the charge roller 1 rotates approximately once. In the downstream adjacencies of the charging nip (Area B in FIG. 25), $V_2\approx V_1$. Therefore, they are expelled from the charge roller 1 onto the photoconductive drum 6.

At this point, as the negative voltage being applied to the transfer station is stopped, the relationship among $V_1$, $V_2$, and $V_3$ becomes: $V_3\approx V_2\approx V_1$.

Some of the positively charged particles stagnating in the upstream adjacencies of the charging nip are freed by this change in the value of $V_3$, and remain held to the charge roller 1 while the charge roller 1 rotates approximately once. Then, they are expelled from the charge roller 1 onto the photoconductive drum 6, by an excessive amount, in the downstream adjacencies of the charging nip.

In the case of an image forming apparatus in which the positively charged particles play an essential role in image formation, the positively charged particles must be recovered and reused.

The above described five cases are summarized in Table 2.

TABLE 2

| CASES | > or < | POLARITIES |
|---|---|---|
| 1 | $v_1 \div v_2 > v_3 \div 0$ | N |
| 2 | $v_1 \div v_2 \div v_3$ | none |
| 3 | $v_1 \div v_2 > v_3$ | N |
| 4 | $v_3 > v_2 > v_1 \div 0$ | P |
| 5 | $v_3 > v_1 \div v_2$ | P |

Next, the case of an image forming apparatus equipped with an exposing apparatus for exposing the points (areas) of developer nonadhesion (points to which toner is not to be adhered) will be described. An example of such an image forming apparatus is an analog copying machine.

Figure 27:
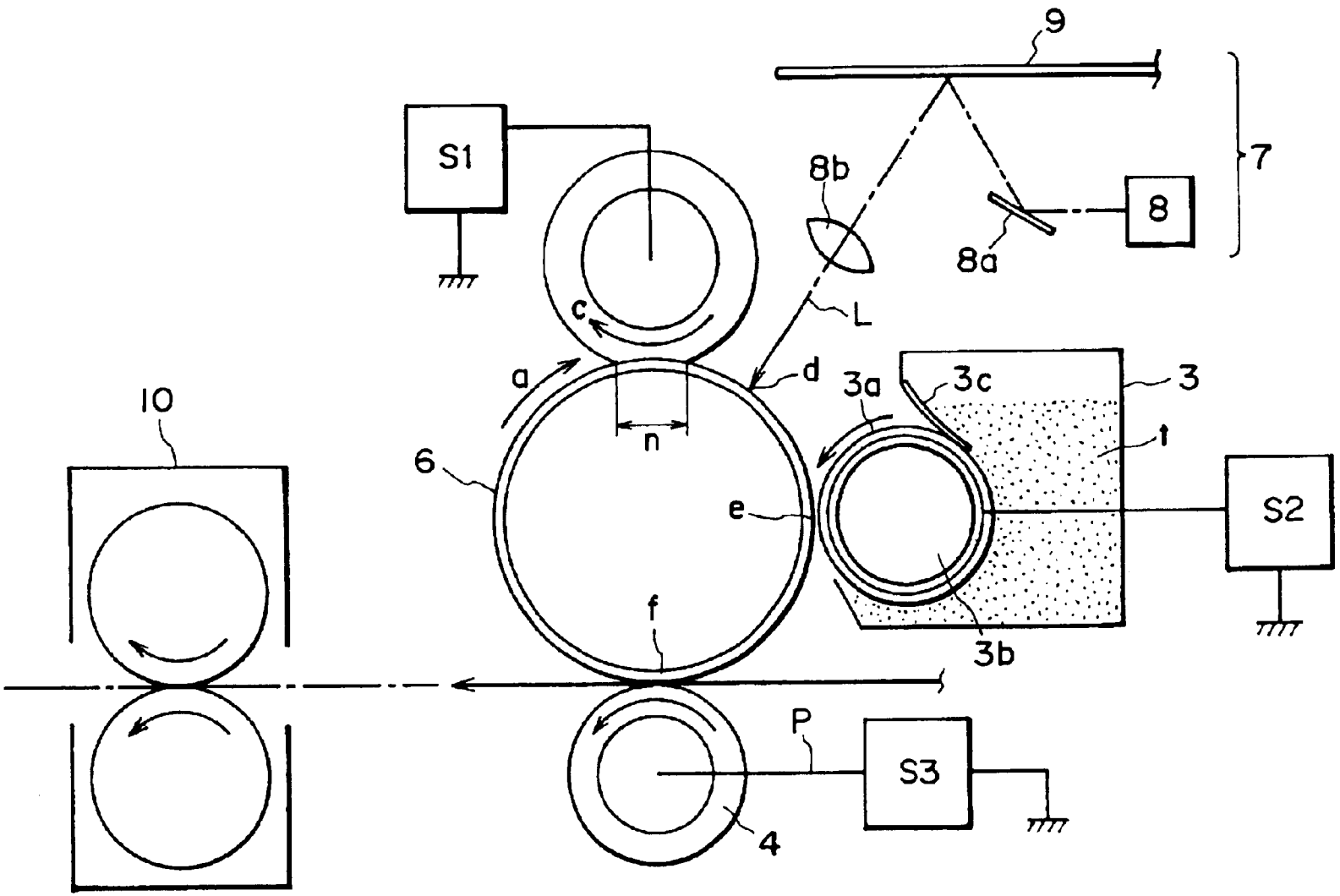
FIG. 27 is a schematic sectional view of an example of an image forming apparatus which does not have a cleaner, counter rotates its charging member, and has an exposing apparatus for exposing the points (areas) of developer non-adhesion.

FIG. 27 shows an example of an image forming apparatus, which has no cleaner, counter rotates its charging member, and has an exposing apparatus 7 for exposing the points (areas) of developer nonadhesion.

This image forming apparatus is similar to the image forming apparatus, shown in FIG. 17, which has no cleaner, counter rotates its charging member, and has an exposing apparatus for exposing the points (areas) of developer adhesion, except that this apparatus has an exposing apparatus for exposing the points (areas) of developer nonadhesion, instead of the laser scanner 2 as an exposing apparatus for exposing the points of developer adhesion, in the apparatus shown in FIG. 17. In operation, an original 9 is set on an unshown glass platen of a moving type, and is moved with the glass platen. In some cases, the original 9 is set on a stationary glass platen, and is moved by an unshown original moving apparatus. As the original 9 is moved, the original 9 is illuminated, across the side to be copied, is illuminated by an illuminating system comprising an exposure lamp 8, a mirror, etc. The light reflected by the surface of the original 9 (or light transmitted through original 9) is focused on the uniformly charged peripheral surface of the rotating photoconductive drum 6 by a projection optical system 8*b*, so that the points of developer nonadhesion on the peripheral surface of the photoconductive drum, are exposed.

As for the method for charging the photoconductive drum 6, electrical charge is injected into the photoconductive drum 6 from the charge roller 1, which is counter rotated in contact with the photoconductive drum 6. The charge roller 1 is capable of deforming, and also is capable of holding, across its peripheral surface, electrically conductive charging performance enhancement particles. The photoconductive drum 6 is charged to the negative polarity. As the developer, toner, which becomes charged inherently to the positive polarity, is used. Otherwise, the structure of this image forming apparatus is the same as that of the apparatus shown in FIG. 17. Therefore, it will be not be described.

Next, the behavior of the transfer residual substances in this apparatus will be discussed, with reference to three cases, which occurs during the image forming operation of this apparatus, and which characterize this apparatus. It is assumed that during a non-image formation periods, such as the preparatory pre-rotation period, preparatory post-rotation period, etc., the entirety of the peripheral surface of the photoconductive drum 6 is charged, and then, is exposed.

During an operation of this image forming apparatus, the values of the surface potential levels $V_1$, $V_2$, and $V_3$ are no less than 0.

Described nest will be that the transfer residual substances stagnating in the upstream adjacencies of the charging nip are changed in polarity, as shown in Table 2, by the change in the relationship among $V_1$, $V_2$, and $V_3$ in terms of magnitude.

Case 6: period in which photoconductive drum is charged and also, a solid black portion of an original is formed.

In this case, the surface potential level of the photoconductive drum is the same as that shown in FIG. 21:

$$V_1 \approx V_2 \approx V_3.$$

Case 7: period in which photoconductive drum is charged and also, a solid white portion of an image is formed.

In this case, the potential level of the photoconductive drum is approximately the same as that shown in FIG. 17:

$$V_1 \approx V_2 > V_3 > 0.$$

Case 8: period corresponding to first charge removal rotation of photoconductive drum In this case, the surface potential level of the photoconductive drum is approximately the same as that shown in FIG. 24. However, $-V_3$ is the potential level after the exposure. Therefore, $$V_3 > V_2 > V_1 = 0\ [V].$$

In Case 6, the particle behavior is roughly the same as that shown in FIG. 20. In the upstream adjacencies of the charging nip (Areas A in FIG. 20), $V_1 \approx V_3$. Therefore, both the positively charged particles and negatively charged particles remain on the photoconductive drum 6. In the charging nip n, the transfer residual substances on the photoconductive drum 6 are mechanically moved (scraped) onto the charge roller 1. Then, they remain adhered to the peripheral surface of the charge roller 1 while the charge roller 1 rotates approximately once.

In the downstream adjacencies of the charging nip (Area B in FIG. 20), $V_1 \approx V_2$. Therefore, both the positively charged particles and negatively charged particles are expelled from the peripheral surface of the charge roller 1 onto the photoconductive drum 6. If they are expelled by an excessive amount onto the photoconductive drum 6, they sometimes interfere with the exposing process for forming an electrostatic latent image, or the photoconductive drum 6 is sometimes nonuniformly charged. After being expelled onto the photoconductive drum 6, they are to be recovered by developing device 3. However, some of them pass the developing device 3.

In Case 7, the particle behavior is the same as that shown in FIG. 22. $V_1 > V_3$, and $V_3$ is approximately equal to the potential level after exposure.

In the upstream adjacencies (Area A in FIG. 22) of the charging nip, the positively charged particles moves from the photoconductive drum 6 onto the charge roller 1, and remain on the charge roller 1 while the charge roller 1 rotates approximately once. In the downstream adjacencies (Area B in FIG. 20) of the charging nip, $V_1 \approx V_2$. Therefore, the positively charged particles are expelled from the peripheral surface of the charge roller 1 onto the photoconductive drum 6.

In comparison, in the upstream adjacencies of the charging nip, the negatively charged particles remain on the photoconductive drum 6, and then, are mechanically removed (scraped away) in the charging nip. However, $V_1 > V_3$. Therefore, they return to the photoconductive drum 6. Thus, the negatively charged particles stagnate in the upstream adjacencies of the charging nip.

If an image forming operation switches from the process for forming a solid black area to the process for forming a solid white areas, while the apparatus is in the above described state, a borderline, one side of which is different in potential level from the other side in terms of the rotational direction of the photoconductive drum, is created on the peripheral surface of the photoconductive drum. This borderline frees the negatively charged particles stagnating in the upstream adjacencies of the charging nip. The freed negatively charged particles are held on the peripheral surface of the charge roller 1, and remain thereon while the charge roller 1 rotates approximately once. Then, they are expelled onto the photoconductive drum 6 by an excessive amount.

The above described phenomenon also occurs as an image forming operation moves from the stage (preparatory stage) in which no image is formed, into the process for forming a solid black image.

In Case 8, the particle behavior is the same as that shown in FIG. 23. Described next will be the particle behavior during the first charge removal rotation of the photoconductive drum ($V_1$=0 [V]).

In this case, $$V_3 > V_2 > V_1 = 0\ [V], \text{ and also}$$

$|V_3 - V_1|$ during the first drum rotation$>|V_3 - V_1|$ during the second drum rotation.

Therefore, in the upstream adjacencies (Area A in FIG. 23) of the charging nip, the positively charged particles remain on the photoconductive drum 6, and then, are mechanically moved (scraped away) onto the charge roller 1 in the charging nip. However, $V_3 > V_1 = 0$ [V]. Therefore, they return to the photoconductive drum 6. In other words, the positively charged particles stagnate in the upstream adjacencies of the charging nip.

In comparison, in the upstream adjacencies of the charging nip, the negatively charged particles move from the photoconductive drum 6 onto the charge roller 1. Then, they remain held on the charge roller 1, while the charge roller 1 is rotated approximately once. In the downstream adjacencies of the charging nip (Area B in FIG. 23), $V_2 > V_1 = 0$ [V]. Therefore, even if the negatively charged particles are expelled from the charge roller 1 onto the photoconductive drum 6, they move back onto the charge roller 1. In other words, the negatively charged particles remain held on the peripheral surface of the charge roller 1.

As the photoconductive drum begins its second discharging rotation, a borderline, one side of which is different in potential level from the other side in terms of the rotational direction of the photoconductive drum, is created on the peripheral surface of the photoconductive drum, at the line which corresponds to the end of the first rotation, that is, the beginning of the second rotation. The potential level gap at this borderline frees some of the negatively charged particles stagnating in the upstream adjacencies of the charging nip. The freed negatively charged particles are held on the peripheral surface of the charge roller 1, and remain thereon while the charge roller 1 rotates approximately once. Then, they are expelled onto the photoconductive drum 6 by an excessive amount.

A phenomenon similar to the above described one also occurs at the borderline on the peripheral surface of the photoconductive drum 6, which corresponds to the end of the second charge removal rotation (which is the beginning of the third rotation), the end of the third drum rotation (which is the beginning of the fourth drum rotation), . . . , although each phenomenon is different from the other in the amount of the particles expelled from the charge roller 1 onto the photoconductive drum 6.

In the case that positively charged particles (for example, external additive added to developer) play an essential role in image formation, it is necessary to recover and reuse the positively charged particles.

The summaries of the above described three cases are given in Table 3.

TABLE 3

| CASES | > or < | POLARITIES |
|---|---|---|
| 1 | $v_1 \div v_2 \div v_3$ | N |
| 2 | $v_1 \div v_2 > v_3 \pm 0$ | N |
| 3 | $v_3 > v_2 > v_1 \div 0$ | P |

As is evident from the above description, the primary object of the present invention is to prevent the image contamination traceable to the phenomenon that, in an image forming apparatus which counter rotates the charging roller, the particles stagnating in the upstream adjacencies of the charging nip are expelled, by an excessive amount, onto the image bearing member by way of the charge roller, by the presence of the gap in potential level on the peripheral surface of the image bearing member, and also to prevent the wasting of the particles, such as developer particles, necessary for image formation. However, it is necessary to take into consideration the fact that in this image forming apparatus, the state of the particles stagnating in the upstream adjacencies of the charging nip is affected by the changes in the voltage applied to the charge roller, for example, whether the DC voltage is on or not; the stagnating particles are released by the presence of the gap in potential level on the peripheral surface of the image bearing member, forming lines parallel to the lengthwise direction of the image bearing member; and the particles released from the upstream adjacencies of the charging nip remain held on the peripheral surface of the charging member, while the charging member rotates approximately once, and then are expelled onto the photoconductive drum in the downstream adjacencies of the charging nip.

Figure 2:
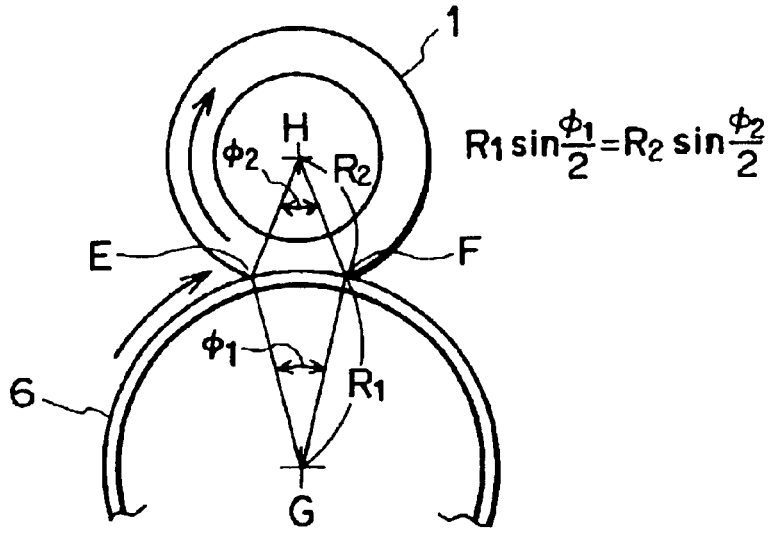
FIG. 2 is a schematic sectional view of the charging nip portion of an image forming apparatus which does not have a cleaner, and counter rotates its charging member, for showing the general structure thereof.

In consideration of the above described facts, all that is necessary is to set up the apparatus so that the voltage for recovering the particles (particles stagnating in upstream adjacencies of charging nip) from the image bearing member into the developing means, will be being applied to the developing means, by the time $t_A$ (sec) passes after the arrival of the line of the voltage gap on the peripheral surface of the image forming apparatus at the upstream adjacencies of the charging nip (Point E in FIG. 2). $t_A$ is the sum of the time from the moment the particles stagnating in the upstream adjacencies of the charging nip transfer onto the peripheral surface of the charge roller 1 after their release from the upstream adjacencies of the charging nip, to the moment they move onto the photoconductive drum after remaining on the charge roller 1 while the charge roller rotates approximately once, and the time it takes for the particles to be conveyed to the center of the developing portion of the developing means after they move to the photoconductive drum.

In other words, $t_A$ is the sum of the time it takes for a given point on the peripheral surface of the charge roller 1 to move from the upstream edge (Point E in FIG. 2) of the charging nip to the downstream edge (Point F in FIG. 2) of the charging nip as the charge roller 1 rotates, and the time it takes for a given point on the peripheral surface of the photoconductive drum to move from the downstream edge of the charging nip to the development station (Point e in FIG. 1) of the developing means.

To put it in another way, all that is necessary is to set up the apparatus so that the voltage for recovering the particles into the developing device will be being applied to the developing device, by the time $t_B$ [sec] passes after the passage of the voltage gap on the peripheral surface of the image bearing member through the center (Point e in FIG. 1) of the development station.

$t_B$=(time it takes for particle to travel from upstream edge of charging nip to the same upstream edge, by bypassing the charging nip by way of the peripheral surface of charge roller, as photoconductive drum rotates)−(time it takes for particle to travel from upstream edge of charging nip to the same upstream edge without bypassing the charging nip by way of the peripheral surface of charge roller, as photoconductive drum rotates).

For example, in the case of an image forming apparatus employing a reversal developing method (points to which toner is to be adhered are exposed), all that is necessary is to set up the apparatus so that the voltage for recovering the developer particles, or particles which are the same in polarity, into the developing device, will be being applied to the developing device, by the time $t_B$ [sec] passes after the passage of the line of surface potential level gap created on the peripheral surface of the image bearing member the moment the first charge removal rotation of the image bearing member turns into the second charge removal rotation, through the center of the development station.

Also in the case, the line of surface potential level gap includes such a line of surface potential level gap that are created as the laser in the on-state is turned off during the automatic power adjustment of the laser scanner. It also includes such a line of surface potential level gap that is created on the peripheral surface of the image bearing member as the transfer voltage, which is applied to the transfer roller, as a transferring member, and the polarity of which is opposite to the normal polarity of the developer, is abruptly reduced in potential level.

Further, an image forming apparatus employing a reversal developing method (points to which toner is adhered are exposed) may be set up so that the voltage for recovering the particles (for example, electrically conductive charging performance enhancement particles), the polarity of which is opposite to the normal polarity to which the developer becomes charged, will be being applied to the developing device, by the term $t_B$ [sec] passes after the passage of the line of surface potential level gap created on the peripheral surface of the image bearing member as the voltage, which is applied to the transfer roller, and the polarity of which is the same as the normal polarity to which the developer becomes charged, is abruptly reduced in potential level, through the center of the development station.

In this case, the line of surface potential level gap created on the image bearing member includes such a borderline, between the exposed and unexposed areas, that are created as the image forming operation switches from the process for forming the points (areas) of toner adhesion (exposed points) to the process for forming the points (areas) of toner nonadhesion (unexposed points). Further, it also includes the line of surface potential level gap created on the peripheral surface of the image bearing member as the first charge removal rotation of the image bearing member turns into the second charge removal rotation.

In comparison, an image forming member employing a normal developing method (points to which toner is not to be adhered are exposed) may be set up so that the voltage for recovering the particles, the polarity of which is opposite to the normal polarity to which the developer is charged, into the developing device, will be being applied to the developing device, by the time $t_B$ [sec] elapsed after the line of potential level gap effected on the peripheral surface of the image bearing member by the sudden potential level reduction in the voltage, which is applied to the transfer roller, and the polarity of which is the same as the normal polarity to which the developer becomes charged, passes the center of the development station.

Also in this case, the line of surface potential level gap on the peripheral surface of the image bearing member includes such a line of surface potential level gap, between the exposed and unexposed areas, that are created as the image forming operation switches from the process for forming the points (areas) of toner adhesion (exposed points) to the process for forming the points (areas) of toner nonadhesion (unexposed points). Further, it also includes the line of surface potential level gap created on the peripheral surface of the image bearing member as the first charge removal rotation of the image bearing member turns into the second charge removal rotation.

In comparison, an image forming apparatus employing a normal developing method (points to which toner is not to be adhered are exposed) may be set up so that the voltage for recovering particles, which are opposite in polarity to the normal polarity to which the developer is charged, into the developing device, will be being applied to the developing device, by the time $t_B$ [sec] elapses after the line of surface potential level gap created between the first and second charge removal rotation of the image bearing member, passes the center of the development station.

Also in this case, the line of surface potential level gap includes such a line of surface potential level gap, between the exposed and unexposed areas, that are created as the image forming operation switches from the process for forming the points (areas) of toner adhesion (exposed points) to the process for forming the points (areas) of toner nonadhesion (unexposed points).

Further, an image forming apparatus employing a normal developing method (points to which toner is not to be adhered are exposed) may be set up so that the voltage for recovering developer, or particles, the polarity of which is the same as the normal polarity to which the developer is charged, into the developing device, will be being applied to the developing device, by the time $t_B$ [sec] elapses after the line of surface potential level gap on the peripheral surface of the image bearing member, which occurs between the first and second charge removal rotation of the image bearing member passes the center of the development station.

If the peripheral velocity of the image bearing member is $V_{PS}$ (mm/sec), the apparatus has only to be set up so that the voltage for recovering the particles from the image bearing member into the developing means is continually applied to the developing means, during the period starting from $t_A-5/(2V_{PS})$ (sec) after the arrival of the aforementioned line of surface potential level gap at the upstream edge of the charging nip, to $t_A+5/(2V_{PS})$ (sec) after the arrival of the line of surface potential level gap at the upstream edge of the charging nip, that is a duration of ($t_{13}-t_{12}$ (sec)).

In other words, the setup has only to be such that the voltage for recovering the particles into the developing device is continuously applied to the developing device between $t_B$ [sec]$-t_P/2$ [sec] and $t_B$ [sec]$+t_P/2$ [sec] after the line of surface potential level gap on the image bearing member passes the center of the development station after passing the charge station: $t_B$=(time it takes for particle to travel from upstream edge of charging nip to the same upstream edge, by bypassing the charging nip by way of the peripheral surface of the charge roller, as photoconductive drum rotates)−(time it takes for particle to travel from upstream edge of charging nip to the same upstream edge without bypassing the charging nip by way of the peripheral surface of the charge roller, as photoconductive drum rotates); $t_P=5/V_{PS}$ ($V_{PS}$ [mm/sec] is the process speed of the image forming apparatus).

Preferably, the setup is such that the voltage for recovering the particles from the image bearing member into the developing means is continuously applied to the developing means from $t_A-5/V_{PS}$ (sec) after the arrival of the line of surface potential level gap at the upstream edge of the charging nip to $t_A+5/V_{PS}$ (sec) after the arrival of the line of surface potential level gap at the upstream edge of the charging nip.

In other words, all that is necessary is that during the period from $t_B$ [sec]$-t_P/2$ [sec] after the line of surface potential level gap on the image bearing member passes the center of the development station after passing the charge station, to the $t_B$ [sec]$+t_P/2$ [sec] after the line of surface potential level gap on the image bearing member passes the center of the development station after passing the charge station, the voltage for recovering the particles into the developing device is continuously applied to the developing means: $t_B$=(time it takes for particle to travel from upstream edge of charging nip to the same upstream edge, by bypassing the charging nip by way of the peripheral surface of the charge roller, as photoconductive drum rotates)−(time it takes for particle to travel from upstream edge of charging nip to the same upstream edge without bypassing the charging nip by way of the peripheral surface of the charge roller, as photoconductive drum rotates); $t_P=5/V_{PS}$ ($V_{PS}$ [mm/sec] is the process speed of the image forming apparatus).

Preferably, the voltage for recovering the particles from the image bearing member into the developing means is continuously applied to the developing means between $t_A-5/V_{PS}$ (sec) to $t_A+5/V_{PS}$ (sec) after the line of surface potential level gap arrives at the upstream adjacencies of the charging nip.

In other words, all that is necessary is to set up the apparatus so that the voltage for recovering particles into the developing device will be being applied to the developing device at least between $t_B$ [sec]$-t_P/2$ [sec] to $t_B$ [sec]$+t_P/2$ [sec] after the passing of the line of surface potential level gap on the image bearing member through the center of the development station after the passing of the charging station. However, $t_B$=(time it takes for particle to travel from upstream edge of charging nip to the same upstream edge, by bypassing the charging nip by way of the peripheral surface of the charge roller, as photoconductive drum rotates) (time it takes for particle to travel from upstream edge of charging nip to the same upstream edge without bypassing the charging nip by way of the peripheral surface of the charge roller, as photoconductive drum rotates); $t_P=10/V_{PS}$ ($V_{PS}$ [mm/sec] is the process speed of the image forming apparatus).

Next, the schematic drawings, which will be referenced to describe the various embodiments of the present invention, will be described.

FIG. 1 is a schematic sectional view of an image forming apparatus, which does not have a cleaner, and which employs the charge roller 1 (charging device) which counter rotates relative to the image bearing member 6, for showing the general structure thereof.

In the drawing, $\theta_1$: angular distance from changing nip n to exposure point d $\theta_2$: angular distance from exposure point d to development point e $\theta_3$: angular distance from development point e to transfer point f $\theta_4$: angular distance from development point f to charging point n $\theta_1+\theta_2+\theta_3+\theta_4=2\pi$ $R_1$: photoconductive drum radius $R_2$: charge roller radius $w_1$: angular velocity of photoconductive drum 6

$w_2$: angular velocity of charge roller 1

Rotational direction of photoconductive drum 6: clockwise

Rotational direction of charge roller 1: clockwise.

FIG. 2 is a schematic sectional view of the charging nip n, and its adjacencies, which the charge roller 1 and photoconductive drum 6 form.

In the drawing,

B: upstream edge of charging nip

F: downstream edge of charging nip

G: rotational axis of photoconductive drum 6

H: rotational axis of charge roller 1

$\phi_1$: angle between Line GE and Line GF $\phi_2$: angle between Line HE and Line HF. Angles $\phi_1$ and $\phi_2$ satisfy:

$$R_1*\sin(\phi_1/2)=R_2*\sin(\phi_2/2)$$

Further, $-V_1$ ($V_1 \geqq 0$): voltage applied to charge roller 1

$-V_2$ ($V_2 \geqq 0$): surface potential level at downstream edge of charge station $-V_3$ ($V_3 \geqq 0$, or $V_3 \leqq 0$): surface potential level at upstream edge of charge station Next, embodiments of operational sequences adoptable by an image forming apparatus in accordance with the present invention will be described.

Figure 3:
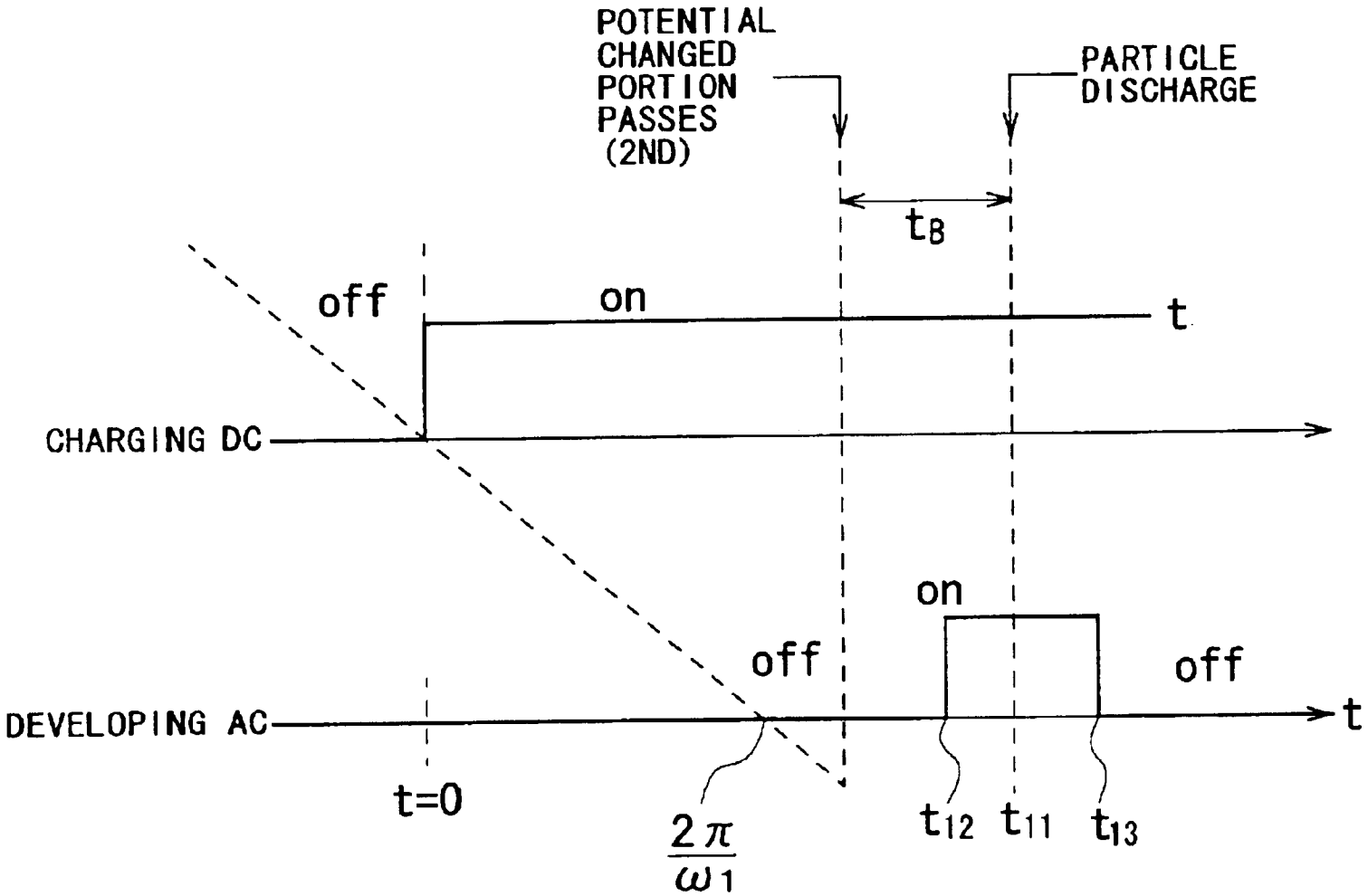
FIG. 3 is a diagram of the control sequence carried out by the first embodiment of an image forming apparatus in accordance with the present invention.

Embodiment 1 (FIG. 3)

FIG. 3 is a diagram for showing the operational sequence of the image forming apparatus (FIG. 17), which exposes the points (areas) of tone adhesion. In this sequence, the development bias is applied in order to recover or reusing the negatively charged particles, which are expelled by an excessive amount from the charge roller 1 onto the photoconductive drum 6 as the surface potential level of the photoconductive drum changes between the first and second drum charging rotations, passes the charge station. In this case, the developer and photoconductive drum are negatively charged.

As described before, during the first drum charging rotation, the negatively charged particles stagnate in the upstream adjacencies of the charging nip. Then, as the surface potential level of the photoconductive drum changes between the first and second drum charging rotations, the negatively charged particles are expelled from the charge roller 1 onto the photoconductive drum 6 by an excessive amount.

Next, the time at which the excessive amount of the expelled negatively charged particles passes the development point e will be calculated. A term t stands for the time at which the charging of the photoconductive drum 6 is started.

Referring to FIGS. 1 and 2, the relationships among: the time ($t_1$) it takes for the downstream edge of the area of the peripheral surface of the photoconductive drum charged during the first drum charging rotation to enter the charging nip (time it takes a given point on the peripheral surface of the photoconductive drum to move from the center of the charging nip to the upstream edge E of the charging nip); time ($t_2$) from when the negatively charged particles stagnating in the upstream adjacencies of the charging nip are released, to when they are expelled in the downstream adjacencies of the charging nip after remaining on the charge roller while the charge roller rotates approximately once (time it takes for a given point on the peripheral surface of the charge roller to move from the upstream edge E of the charging nip to the downstream edge F of the charging nip, as the charge roller rotates); time ($t_3$) it takes for the expelled negatively charged particles to move from the downstream edge of the charging nip to the center of the development station (time it takes for a given point on the peripheral surface of the photoconductive drum to move from the downstream edge F of the charging nip to the center e of the development station), are:

$$t_1=(2\pi-\phi_1/2)/w_1,$$

$$t_2=(2\pi-\phi_2)/w_2,$$

$$t_3=(\theta_1+\theta_2-\phi_1/2)/w_1.$$

Therefore, in order to recover the excessive amount of the negatively charged particles expelled from the charge roller 1 onto the photoconductive drum 6, by the developing device 3 (more specifically, development sleeve 3*a*), the apparatus is set up so that the development AC voltage for recovering the negatively charged particles, will be being continuously applied to the developing device 3, by the time $t_1+t_2+t_3=(2\pi+\phi_1+\phi_2-\phi_1)/w_1+(2\pi-\phi_2)/w_2$ [sec] elapse after the photoconductive drum begins to the be charged.

It is preferred that the development AC voltage is applied long enough to recover most of the excessive amount of the negatively charged particles expelled from the charge roller 1 onto the photoconductive drum 6 by the developing device 3, that is, a length of ($t_{12}-t_{13}$), with $t_{11}=(2\pi+\theta_1+\theta_2-\phi_1)/w_1+(2\pi-\phi_2)/w_2$ [sec], being the mid point of ($t_{12}-t_{13}$). More preferably, $t_{11}-t_{12}=t_{13}-t_{11}=5/2V_{PS}$). Most preferably, $t_{11}-t_{12}=t_{13}-t_{11}=5/V_{PS}$.

Here, $t_A=t_2+t_3$, and $t_B$=(time it takes for a given point on the peripheral surface of the photoconductive drum to move from Point F to Point E)+(time it takes for a given point on the peripheral surface of the charge roller to move from Point E to Point F)−(time it takes for the photoconductive drum to rotate once).

In all of the following embodiments, $t_A$ and $t_B$ are the same as those in Embodiment 1.

Figure 4:
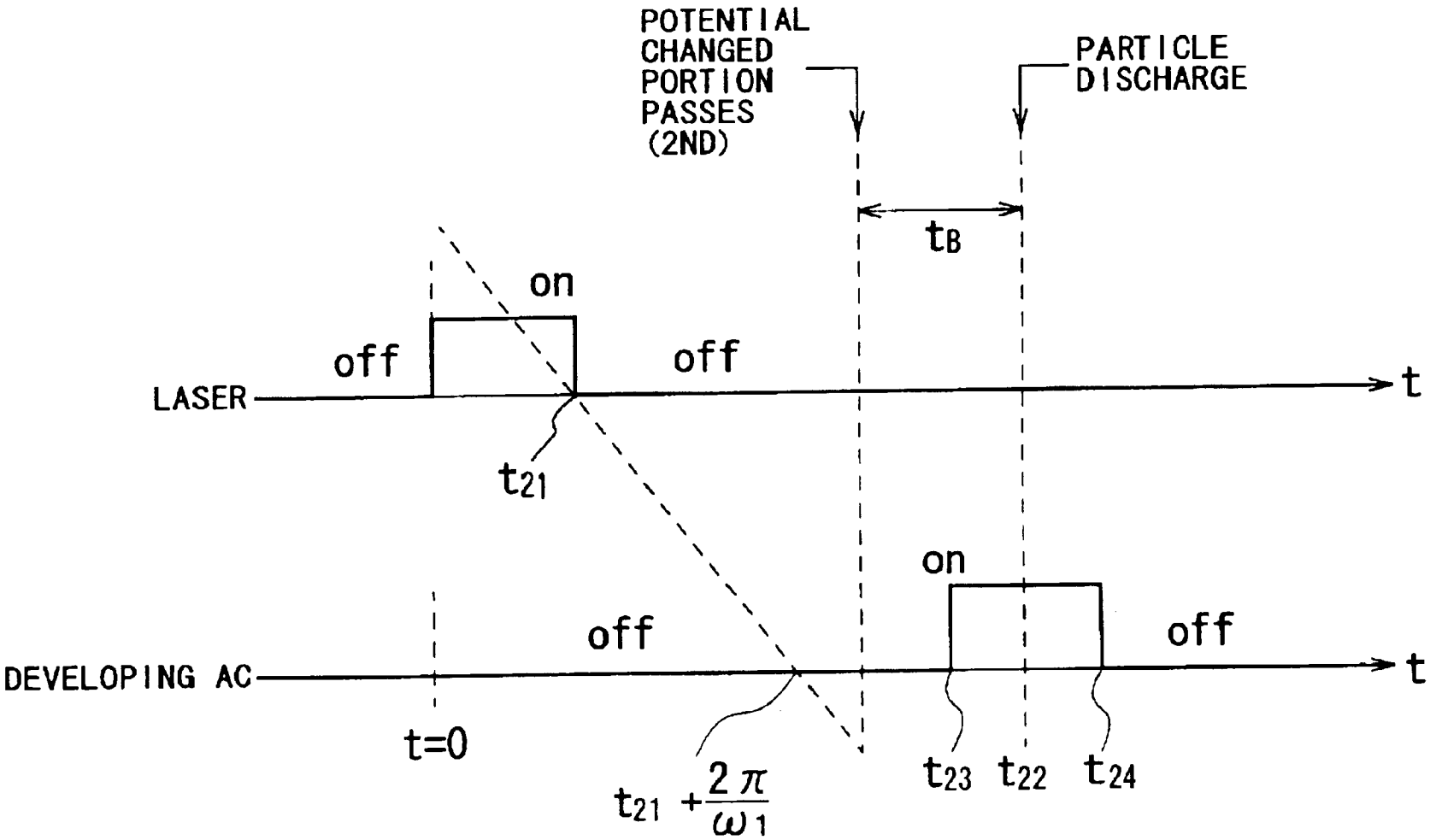
FIG. 4 is a diagram of the control sequence carried out by the second embodiment of an image forming apparatus in accordance with the present invention.

Embodiment 2 (FIG. 4)

FIG. 4 is a diagram for showing the operational sequence of the image forming apparatus (FIG. 17), which exposes the points (areas) of toner adhesion. In this case, the development bias is applied to recover or reuse the excessive amount of the negatively charged particles, which are expelled from the charge roller 1 onto the photoconductive drum 6 as the surface potential level of the photoconductive drum changes due to the automatic laser power adjustment of the laser scanner 2.

This sequence is carried out while no image is formed (during preparatory period), for example, the preparatory pre-rotation period, preparatory post-rotation period, etc. The developer and photoconductive drum are negatively charged.

The automatic laser power adjustment means the control for adjusting the laser output to a proper level by adjusting the amount of the current flowed to the semiconductor laser, during the preparatory pre-rotation period. This control ensures that the photoconductive drum is charged to a predetermined potential level, ensuring thereby that all the exposed points on the peripheral surface of the photoconductive drum are uniform in potential level (at the predetermined level).

During the automatic laser power adjustment, the laser is turned on and off. While the laser is on, $V_1 \approx V_2 > V_3$, whereas while the laser is off, $V_1 \approx V_2 \approx V_3$. Therefore, while the laser is on, the negatively charged particles are stagnating in the upstream adjacencies of the charging nip. However, as the laser is turned off, the surface potential level of the photoconductive drum changes, causing the negatively charged particles to be expelled.

In other words, as the laser scanner 2, which is on, is turned off by the automatic laser power control, the surface potential level of the photoconductive drum changes, causing the negatively charged particles to be expelled from the charge roller 1 onto the photoconductive drum 6 by an excessive amount. When the time at which the laser is turned on is t (=0 [sec]), and the time at which the laser is turned off is $t_{21}$ [sec], the time at which the excessive amount of the expelled negatively charged particles passes the development station is calculated as follows.

Referring to FIGS. 1 and 2, the relationship among: the time ($t_4$) it takes for the point of the peripheral surface of the photoconductive drum 6 corresponding to the moment the laser is turned off, in other words, the point of the surface potential change, to enter the charging nip n (the time it takes for a given point on the peripheral surface of the photoconductive drum 6 to move from Point d in FIG. 1 to Point E in FIG. 2, as the photoconductive drum 6 rotates); time ($t_2$) from when the negatively charged particles stagnating in the upstream adjacencies of the charging nip are released, to when they are expelled in the downstream adjacencies of the charging nip after remaining on the charge roller while the charge roller rotates approximately once; time ($t_3$) it takes for the expelled negatively charged particles to move from the downstream edge of the charging nip to the center of the development station (time it takes for a given point on the peripheral surface of the photoconductive drum to move from the downstream edge F of the charging nip to the center e of the development station), are:

$$t_4=(2\pi-\theta^1-\phi_1/2)/w_1,$$

$$t_2=(2\pi-\phi_2)/w_2,$$

$$t_3=(\theta_1+\theta_2-\phi_1/2)/w_1.$$

Therefore, in order to recover the excessive amount of the negatively charged particles expelled from the charge roller 1 onto the photoconductive drum 6, by the developing device 3, the apparatus is set up so that the development AC voltage for recovering the negatively charged particles, will be being continuously applied to the developing device 3, by the time $t_{21}+t_2+t_3+t_4=t_{21}+(2\pi+\theta_2-\phi_1)/w_1+(2\pi-\phi_2)/w_2$ [sec] elapses after the laser is turned on.

It is preferred that the development AC voltage is applied for a duration sufficient to recover most of the excessive amount of the negatively charged particles expelled from the charge roller 1 onto the photoconductive drum 6 by the developing device 3, between ($t_{23}-t_{24}$), with $t_{21}=t_{21}+(2\pi+\theta 2-\phi_1)/w_1+(2\pi-\phi_2)/w_2$ [sec] being the mid point between ($t_{23}-t_{24}$). More preferably, $t_{22}-t_{23}=t_{24}-t_{22}=5/2V_{PS}$). Most preferably, $t_{22}-t_{23}=t_{24}-t_{22}=5/V_{PS}$.

Embodiment 3 (FIG. 4)

Figure 5:
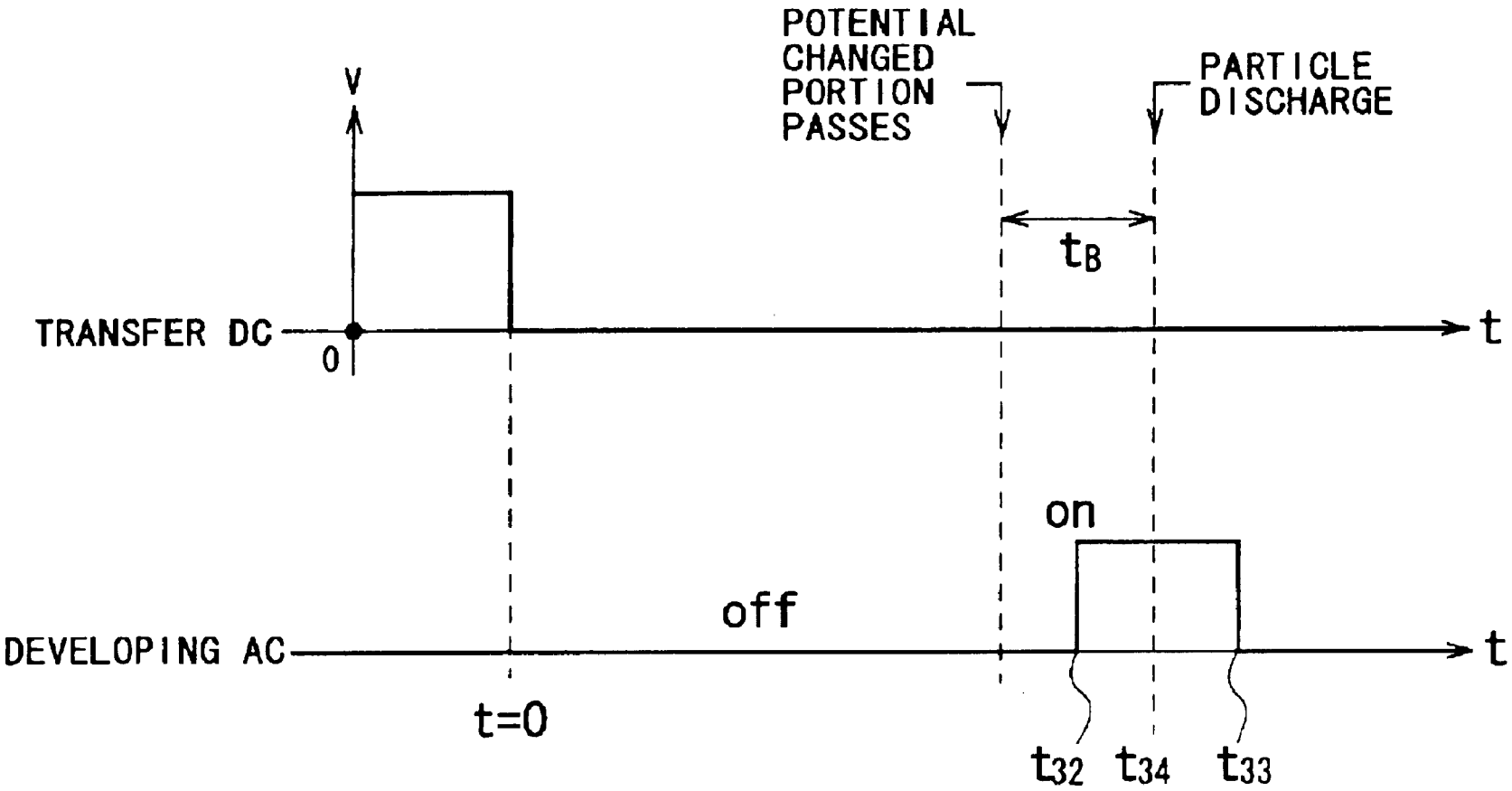
FIG. 5 is a diagram of the control sequence carried out by the third embodiment of an image forming apparatus in accordance with the present invention.

FIG. 5 is a diagram for showing the operational sequence of the image forming apparatus (FIG. 17), which exposes the points (areas) of toner adhesion. In this case, the development bias is applied to recover or reuse the excessive amount of the negatively charged particles, which are expelled from the charge roller 1 onto the photoconductive drum 6 as the surface potential level of the photoconductive drum changes due to the drop of the positive voltage applied to the transfer station, from the high potential level to the low potential level.

This sequence is carried out while no image is formed (during preparatory period), for example, the preparatory pre-rotation period, preparatory post-rotation period, etc. The developer and photoconductive drum are negatively charged.

While the positive voltage is applied to the transfer station f, the photoconductive drum becomes charged. In this sequence, $-V_3$ may take on a positive value.

As the surface potential level of the photoconductive drum changes due to the change of the setting of the positive voltage applied to the transfer station f, from the high to the low, the following condition occurs:

($-V_3$ during the application of the low voltage to the transfer station)<($-V_3$ during the application of the high voltage to the transfer station).

Whether the high voltage or low voltage is applied to the transfer station f, $V_1 \approx V_2 > V_3$. Therefore, the force which holds the negatively charged particles is stronger while the high voltage is applied than while the low voltage is applied. Therefore, as the potential of the voltage applied to the transfer station f is switched from the high level to the low level, the negatively charged particles are expelled from the charge roller 1 onto the photoconductive drum 6 by an excessive amount. The time it takes for the excessive amount of the negative particles expelled onto the photoconductive drum 6 to pass the development station, from the moment (t=0 [sec]) of the voltage switch, can be calculated as follows.

Referring to FIGS. 1 and 2, the relationship among: the time ($t_5$) from when the potential level of the voltage applied to the transfer station f is switched from the high to the low, to when the line of surface potential level gap on the peripheral surface of the photoconductive drum 6 enters the charging nip n (the time it takes for a given point on the peripheral surface of the photoconductive drum 6 to move from Point f to Point E, as the photoconductive drum 6 rotates); time ($t_2$) from when the negatively charged particles stagnating in the upstream adjacencies of the charging nip are released, to when they are expelled in the downstream adjacencies of the charging nip after remaining on the charge roller while the charge roller rotates approximately once; time ($t_3$) it takes for the expelled negatively charged particles to move from the downstream edge of the charging nip to the center of the development station, are:

$$t_5=(\theta_4-\phi_1/2)/w_1,$$

$$t_2=(2\pi-\phi_2)/w_2,$$

$$t_3=(\theta_1+\theta_2-\phi_1/2)/w_1.$$

Therefore, in order to recover the excessive amount of the negatively charged particles expelled from the charge roller 1 onto the photoconductive drum 6, by the developing device 3, the apparatus is set up so that the development AC voltage for recovering the negatively charged particles, will be being continuously applied to the developing device 3, by the time $t_2+t_3+t_5=(2\pi-\theta_3-\phi_1)/w_1+(2\pi-\phi_2)/w_2$ [sec] elapses after the moment the potential level of the voltage applied to the transfer station f is switched from the high to the low.

It is preferred that the development AC voltage is applied for a duration sufficient to recover, by the developing device 3, most of the excessive amount of the negatively charged particles expelled from the charge roller 1 onto the photoconductive drum 6, that is, between ($t_{32}-t_{33}$) with $t_{31}=(2\pi-\theta_3-\phi_1)/w_1+(2\pi-\phi_2)/w_2$ [sec] being the mid point of ($t_{32}-t_{33}$): $t_{31}-t_{32}=t_{33}-t_{31}$.

Figure 6:
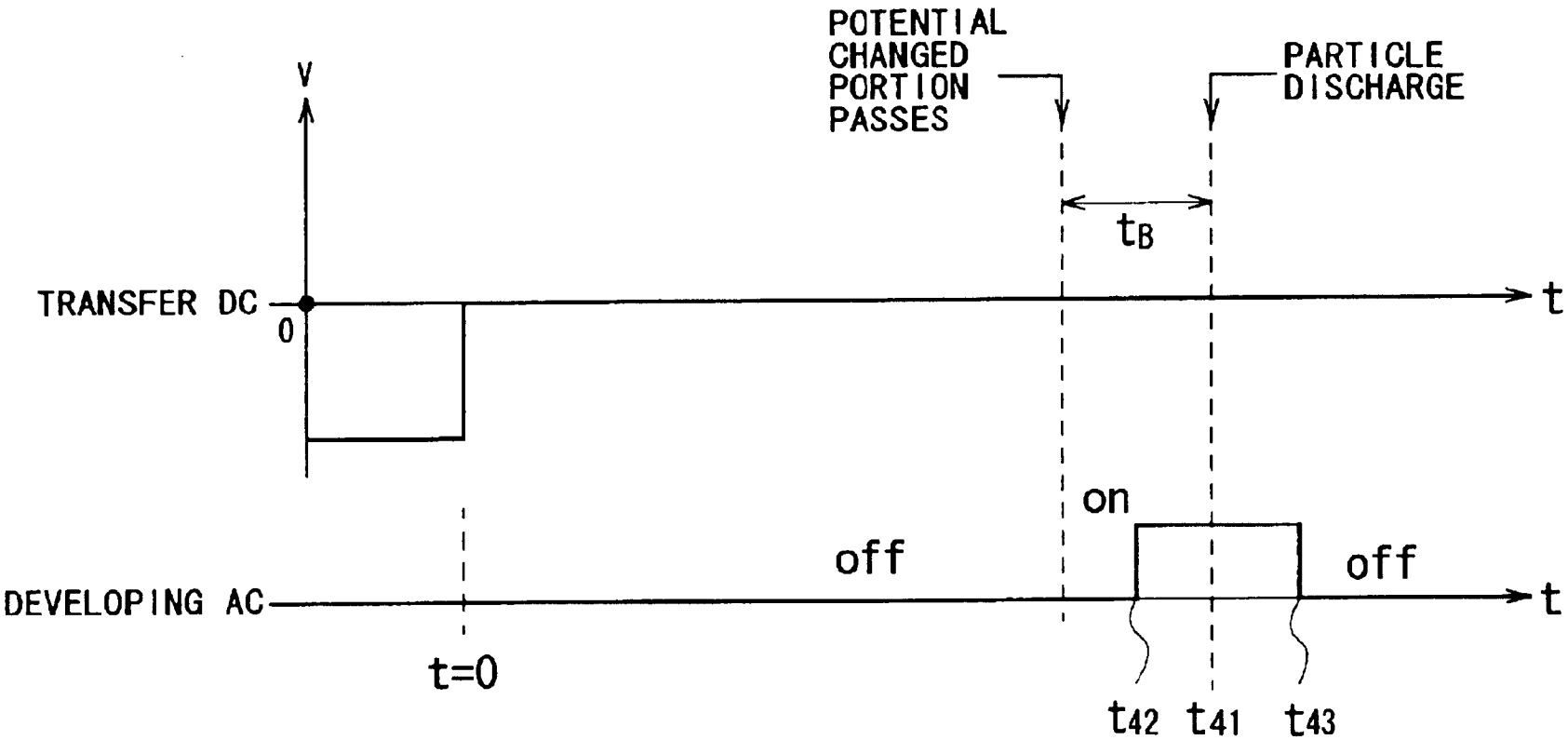
FIG. 6 is a diagram of the control sequence carried out by the fourth embodiment of an image forming apparatus in accordance with the present invention.

Embodiment 4 (FIG. 6)

FIG. 6 is a diagram for showing the operational sequence of the image forming apparatus (FIG. 17), which exposes the points (areas) of toner adhesion. In this sequence, the development bias is applied to recover or reuse the excessive amount of the negatively charged particles, which are expelled from the charging device onto the photoconductive drum as the surface potential level of the photoconductive drum changes due to the change of the negative voltage applied to the transfer station, from the high to the low.

This sequence is carried out while no image is formed (during preparatory period), for example, during the preparatory pre-rotation period, preparatory post-rotation period, etc. The developer and photoconductive drum are negatively charged.

While the positive voltage is applied to the transfer station f, the photoconductive drum becomes charged. In this sequence, $-V_3$ takes on a positive value.

As the surface potential level of the photoconductive drum changes due to the switching of the potential level of the negative voltage applied to the transfer station f, from the high to the low, the following condition occurs:

($-V_3$ during the application of the low voltage to the transfer station)>($-V_3$ during the application of the high voltage to the transfer station).

Further, whether the high voltage or low voltage is applied to the transfer station f, $V_1 \approx V_2 < V_3$. Therefore, the force which holds the positively charged particles is stronger while the high voltage is applied than while the low voltage is applied. Therefore, as the potential of the voltage applied to the transfer station f is switched from the high level to the low level, the positively charged particles are expelled from the charging device 1 onto the photoconductive drum 6 by an excessive amount. The time it takes for the excessive amount of the positively charged particles expelled onto the photoconductive drum 6 to pass the development station e, from the moment (t=0 [sec]) of the voltage switch, can be calculated as follows.

Referring to FIGS. 1 and 2, the relationship among: the time ($t_5$) from when the potential level of the voltage applied to the transfer station f is switched from the high to the low, to when the line of surface potential level gap on the peripheral surface of the photoconductive drum 6 enters the charging nip n; time ($t_2$) from when the positively charged particles stagnating in the upstream adjacencies of the charging nip are released, to when they are expelled in the downstream adjacencies of the charging nip after remaining on the charge roller while the charge roller rotates approximately once; time ($t_3$) it takes for the expelled negatively charged particles to move from the downstream edge of the charging nip to the center of the development station, are:

$$t_5=(\theta 4-\phi_1/2)/w_1,$$

$$t_2=(2\pi-\phi_2)/w_2,$$

$$t_3=(\theta_1+\theta_2-\phi_1/2)/w_1.$$

Therefore, in order to recover, by the developing device 3, the excessive amount of the positively charged particles expelled from the charge roller 1 onto the photoconductive drum 6, the apparatus is set up so that the development AC voltage for recovering the positively charged particles, will be being continuously applied to the developing device 3, by the time $(2\pi-\theta_3-\phi_1)/w_1+(2\pi-\phi_2)/w_2$ [sec] elapses after the moment the potential level of the voltage applied to the transfer station f is switched from the high to the low.

It is preferred that the development AC voltage is applied for a duration sufficient to recover, by the developing device 3, most of the excessive amount of the positively charged particles expelled from the charge roller 1 onto the photoconductive drum 6, that is, between ($t_{42}-t_{43}$) with $t_{41}=(2\pi-\theta_3-\phi_1)/w_1+(2\pi-\phi_2)/w_2$ [sec] being mid point of ($t_{42}-t_{43}$): $t_{41}-t_{42}=t_{43}-t_{41}=t_{11}-t_{12}$.

Figure 7:
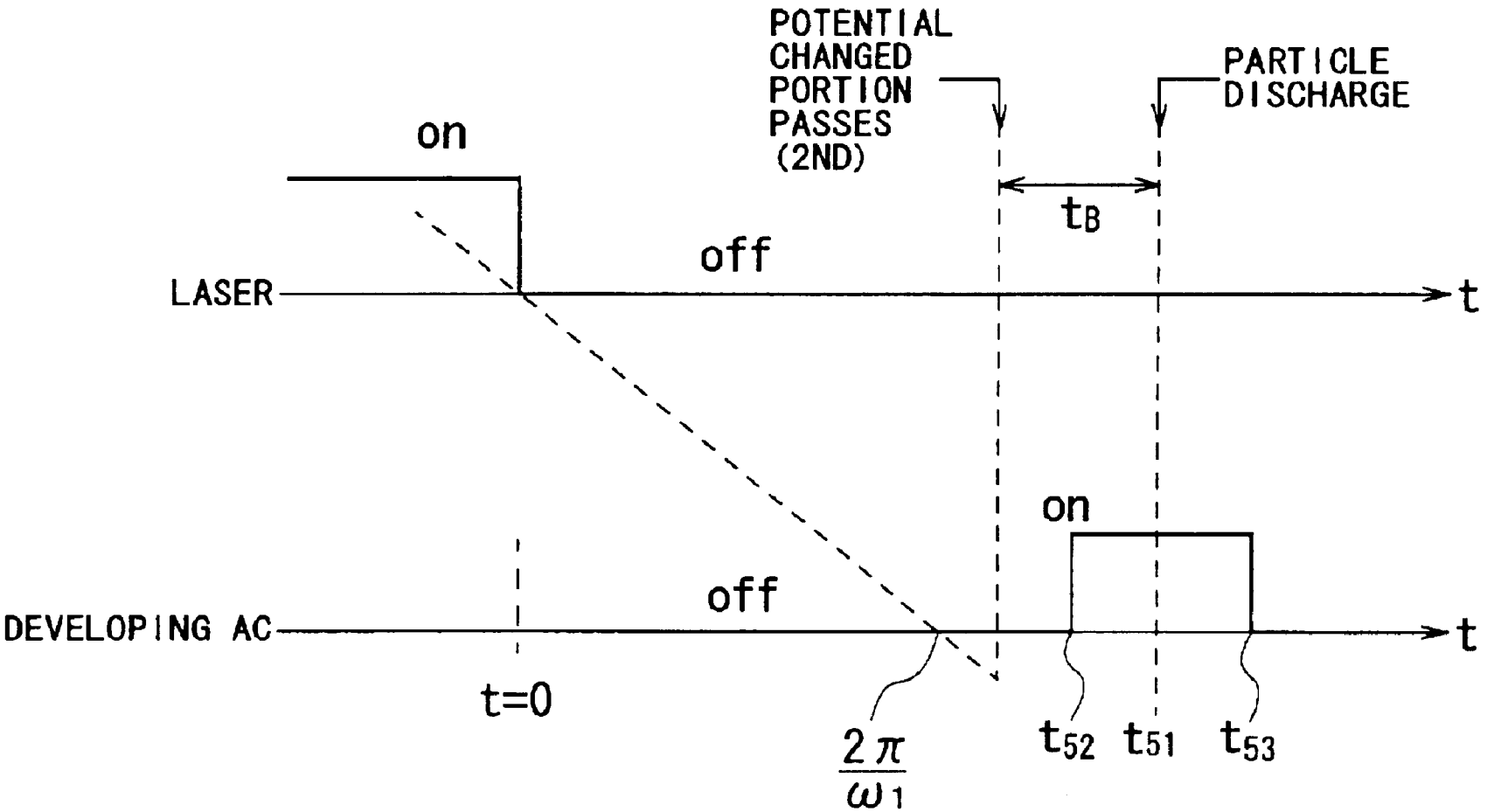
FIG. 7 is a diagram of the control sequence carried out by the fifth embodiment of an image forming apparatus in accordance with the present invention.

Embodiment 5 (FIG. 7)

FIG. 7 is a diagram for showing the operational sequence of the image forming apparatus (FIG. 17), which exposes the points (areas) of toner nonadhesion. In this sequence, the development bias is applied to recover or reuse the excessive amount of the negatively charged particles, which are expelled from the charge roller 1 onto the photoconductive drum as the surface potential level of the photoconductive drum changes due to the switching of the image forming operation from the process for forming the solid black area of the image being formed, to the process for forming the solid white area of the image. In this sequence, the developer and photoconductive drum are negatively charged, and $-V_3$ takes on a negative value.

As the surface potential level of the photoconductive drum changes due to the switching of the image forming operation from the process for forming the solid black area of the image being formed, to the process for forming the solid white area of the image, the following condition occurs:

($-V_3$ during the formation of the solid black area)>($-V_3$ during the formation of the solid white area). Further, during the formation of the solid black area $$V_1 \approx V_2 > V_3, \text{ whereas}$$

during the formation of the solid white area $$V_1 \approx V_2 \approx V_3.$$

Therefore, during the formation of the solid black area, the negatively charged particles stagnate in the upstream charging nip, and are expelled from the charge roller 1 onto the photoconductive drum 6 by an excessive amount at the moment of the switching from the solid black area to the solid white area. The time it takes for the excessive amount of the expelled negatively charged particles to pass the development station e, from the moment (t=0 [sec]) of the switch from the solid black area to the solid white area, is calculated as follows.

During the formation of the solid black area, the laser is on, whereas during the formation of the solid white area, the laser is off.

Referring to FIGS. 1 and 2, the relationship among: the time ($t_4$) from the moment the laser is turned off, to the moment the line of surface potential level gap enters the charging nip n; time ($t_2$) from the moment the negatively charged particles stagnating in the upstream adjacencies of the charging nip are released, to the moment they are expelled in the downstream adjacencies of the charging nip; time ($t_3$) it takes for the expelled negatively charged particles to move from the downstream edge of the charging nip to the center of the development station, are:

$$t_4=(2\pi-\theta_1-\phi_1/2)/w_1,$$

$$t_2=(2\pi-\phi_2)/w_2,$$

$$t_3=(\theta_1+\theta_2-\phi_1/2)/w_1.$$

Therefore, in order to recover, by the developing device 3, the excessive amount of the negatively charged particles expelled from the charge roller 1 onto the photoconductive drum 6, the apparatus is set up so that the development AC voltage for recovering the negatively charged particles, will be being continuously applied to the developing device 3, by the time $t_2+t_3+t_4=(2\pi+\theta_2-\phi_1)/w_1+(2\pi-\phi_2)/w_2$ [sec] elapses after the moment the state of the laser changes from the ON-state to the OFF-state.

It is preferred that the development AC voltage is applied for a duration sufficient to recover, by the developing device 3, most of the excessive amount of the negatively charged particles expelled from the charge roller 1 onto the photoconductive drum 6, that is, between ($t_{42}-t_{43}$), with $t_{51}=(2\pi-\theta_2-\phi_1)/w_1+(2\pi-\phi_2)/w_2$ [sec] being the mid point of ($t_{42}-t_{43}$): $t_{51}-t_{52}=t_{53}-t_{51}=t_{11}-t_{12}$.

Figure 8:
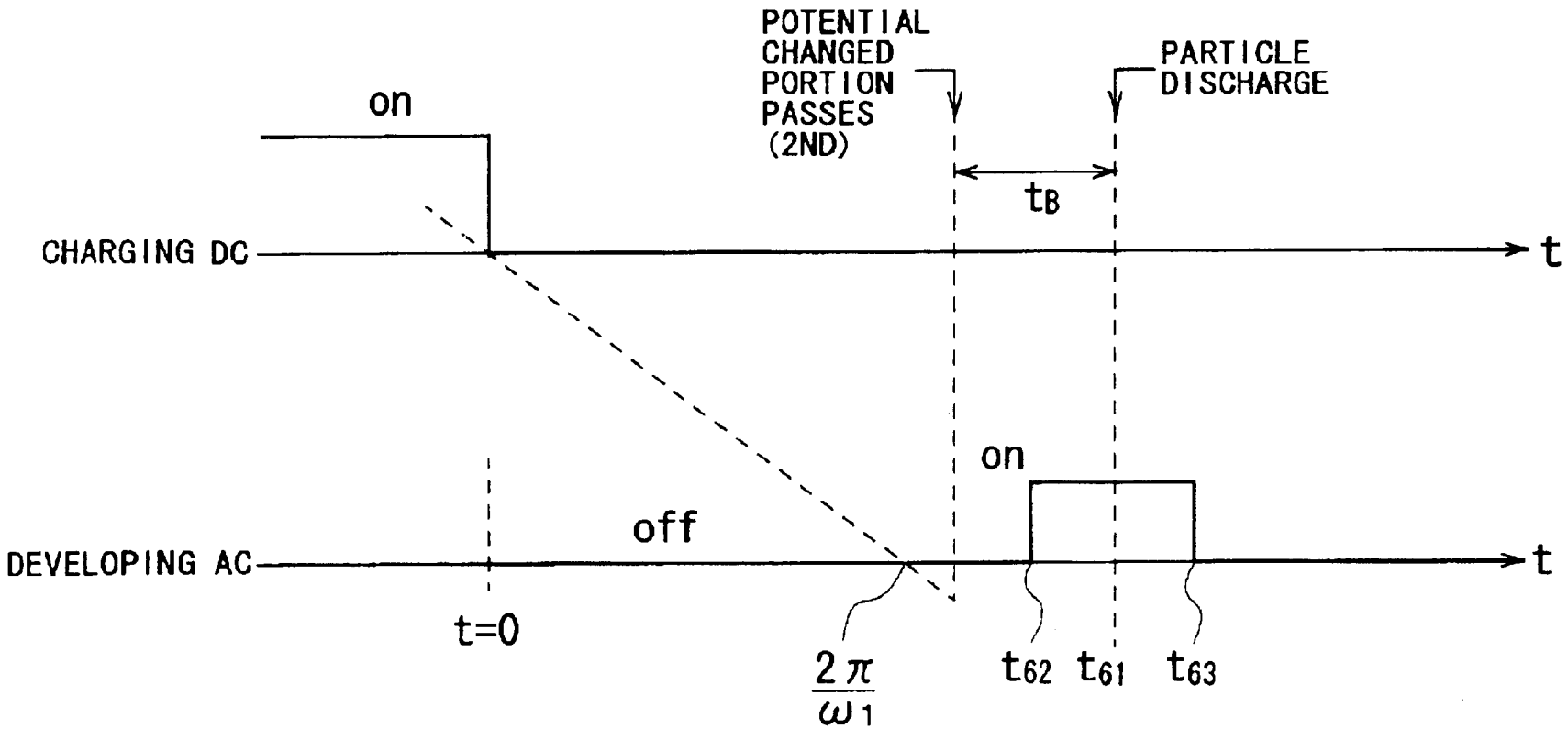
FIG. 8 is a diagram of the control sequence carried out by the sixth embodiment of an image forming apparatus in accordance with the present invention.

Embodiment 6 (FIG. 8)

FIG. 8 is a diagram for showing the operational sequence of the image forming apparatus (FIG. 17), which exposes the points (areas) of toner nonadhesion. In this sequence, the development bias is applied to recover or reuse the excessive amount of the positively charged particles, which are expelled from the charge roller 1 onto the photoconductive drum 6 as the surface potential level of the photoconductive drum changes due to the switching of the charge removal rotation of the photoconductive drum from the first to the second. In this sequence, the developer and photoconductive drum are negatively charged, and $-V_3$ takes on a negative value.

As the surface potential level of the photoconductive drum changes due to the switching of the charge removal rotation of the photoconductive drum 6 from the first rotation to the second rotation, the following condition occurs: $|V_3-V_1|$ during the first drum rotation>$|V_3-V_1|$ during the second drum rotation. Further, $$V_3>V_2>V_1=0\ [V]$$

Therefore, the force which confines the positively charged particles is stronger during the first charge removal rotation of the photoconductive drum than during the second charge removal rotation of the photoconductive drum.

Therefore, an excessive amount of the positively charged particles is expelled from the charge roller 1 onto the photoconductive drum 6 at the moment of the switching. The time it takes for the excessive amount of the expelled positively charged particles to pass the development station e, from the moment (t=0 [sec]) of the switch from the first charge removal rotation of the photoconductive drum 6 to the second charge removal rotation of the photoconductive drum 6, is calculated as follows.

Referring to FIGS. 1 and 2, the relationship among: the time ($t_1$) from the moment the electrical charge begins to be removed from the photoconductive drum 6, to the moment the point of the surface potential level change on the peripheral surface of the photoconductive drum 6 enters the charging nip n; time ($t_2$) from the moment the positively charged particles stagnating in the upstream adjacencies of the charging nip are released, to the moment they are expelled in the downstream adjacencies of the charging nip after remaining on the charge roller 1 while the charge roller 1 rotates approximately once; time ($t_3$) it takes for the expelled positively charged particles to move from the downstream edge of the charging nip to the center of the development station, are:

$$t_1=(2\pi-\phi_1/2)/w_1,$$

$$t_2=(2\pi-\phi_2)/w_2,$$

$$t_3=(\theta_1+\theta_2-\phi_1/2)/w_1.$$

Therefore, in order to recover, by the developing device 3, the excessive amount of the positively charged particles expelled from the charge roller 1 onto the photoconductive drum 6, the apparatus is set up so that the development AC voltage for recovering the positively charged particles, will be being continuously applied to the developing device 3, by the time $(2\pi+\theta_1+\theta_2-\phi_1)/w_1+(2\pi-\phi_2)/w_2$ [sec] elapses after the moment the electrical charge begins to be removed from the photoconductive drum 6.

It is preferred that the development AC voltage is applied for a duration sufficient to recover, by the developing device 3, most of the excessive amount of the positively charged particles expelled from the charge roller 1 onto the photoconductive drum 6, that is, between ($t_{62}-t_{63}$), with $t_{61}=(2\pi-\theta_2-\phi_1)/w_1+(2\pi-\phi_2)/w_2$ [sec] being the mid point of ($t_{62}-t_{63}$): $t_{61}-t_{62}=t_{63}-t_{61}=t_{11}-t_{12}$.

Further, the difference in potential level between the one side of the line of surface potential level gap and the other side, on the peripheral surface of the photoconductive drum 6, in the x-th charge removal rotation of the photoconductive drum 6 is smaller than that in the (x−1)-th charge removal rotation of the photoconductive drum 6. It is desired that the development AC bias is continuously applied until the charge removal rotation of the photoconductive drum 6 is stopped.

Embodiment 7 (FIG. 5)

This embodiment relates to the operational sequence of the image forming apparatus (FIG. 27), which exposes the points (areas) of toner nonadhesion. In this sequence, the development bias is applied to recover or reuse the excessive amount of the negatively charged particles, which are expelled from the charging roller 1 onto the photoconductive drum 6 as the surface potential level of the photoconductive drum 6 changes due to the change of the setting of the positive voltage applied to the transfer station f, from the high to the low. The diagram for this sequence is the same as the one in FIG. 5.

This sequence is carried out while no image is formed (during preparatory period), for example, during the preparatory pre-rotation period, preparatory post-rotation period, etc. The developer is positively charged, whereas the photoconductive drum is negatively charged.

Before applying the positive voltage to the transfer station during the preparatory period, such as the preparatory pre-rotation period, preparatory post-rotation period, etc., the photoconductive drum is exposed across the entirety of its peripheral surface after it is charged.

While the positive voltage is applied to the transfer station f, the photoconductive drum 6 becomes charged. In this sequence, $-V_3$ may take on a positive value.

As the surface potential level of the photoconductive drum changes due to the switching of the potential level of the negative voltage applied to the transfer station f, from the high to the low, the following condition occurs:

($-V_3$ during the application of the low voltage to the transfer station)<($-V_3$ during the application of the high voltage to the transfer station).

Further, whether the high voltage or low voltage is applied to the transfer station f, $V_1 \approx V_2 > V_3$. Therefore, while the solid white portion of an image being formed is formed, the negatively charged particles stagnate in the upstream adjacencies of the charging nip.

However, the force which confines the negatively charged particles is stronger while the solid white portion is formed than while the solid black portion is formed. Therefore, as the potential of the voltage applied to the transfer station f is switched from the high level to the low level, the negatively charged particles are expelled from the charging device 1 onto the photoconductive drum 6 by an excessive amount.

The time it takes for the excessive amount of the expelled negatively charged particles to pass the development station e, from the moment (t=0 [sec]) the potential level of the voltage applied to the transfer station f is switched from the high to the low, can be calculated as follows.

Referring to FIGS. 1 and 2, the relationship among: the time ($t_5$) from when the potential level of the voltage applied to the transfer station f is switched from the high to the low, to when the line of surface potential level gap on the peripheral surface of the photoconductive drum 6 enters the charging nip n; time ($t_2$) from when the negatively charged particles stagnating in the upstream adjacencies of the charging nip are released, to when they are expelled in the downstream adjacencies of the charging nip after remaining on the charge roller while the charge roller rotates approximately once; time ($t_3$) it takes for the expelled negatively charged particles to move from the downstream edge of the charging nip to the center of the development station, are:

$$t_5=(\theta_4-\phi_1/2)/w_1,$$

$$t_2=(2\pi-\phi_2)/w_2,$$

$$t_3=(\theta_1+\theta_2-\phi_1/2)/w_1.$$

Therefore, in order to recover, by the developing device 3, the excessive amount of the negatively charged particles expelled from the charge roller 1 onto the photoconductive drum 6, the apparatus is set up so that the development AC voltage for recovering the negatively charged particles, will be being continuously applied to the developing device 3, by the time $(2\pi-\theta_3-\phi_1)/w_1+(2\pi-\phi_2)/w_2$ [sec] elapses after the moment the potential level of the voltage applied to the transfer station f is switched from the high to the low.

It is preferred that the development AC voltage is applied for a distance of ($t_{32}-t_{33}$) sufficient to recover, by the developing device 3, most of the excessive amount of the negatively charged particles expelled from the charge roller 1 onto the photoconductive drum 6, with the $t_{31}=(2\pi-\theta_3-\phi_1)/w_1+(2\pi-\phi_2)/w_2$ [sec] being the mid point of ($t_{32}-t_{33}$).

Embodiment 8 (FIG. 7)

This embodiment relates to the operational sequence of the image forming apparatus (FIG. 27), which exposes the points (areas) of toner nonadhesion. In this sequence, the development bias is applied to recover or reuse the excessive amount of the negatively charged particles, which are expelled from the charging device 1 onto the photoconductive drum 6 as the surface potential level of the photoconductive drum 6 changes due to the switching of the image forming process from the process for forming a solid white portion to the process for forming a solid black portion.

The diagram for this sequence is the same as the one in FIG. 7, except that in this case, the laser has been replaced with an exposure lamp 8 (FIG. 8). The developer is positively charged, whereas the photoconductive drum is negatively charged. In this embodiment, $-V_3$ takes on a positive value.

As the surface potential level of the photoconductive drum changes due to the switching of the image formation process from the process for forming a solid white portion, to the process for forming a solid black portion, the following condition occurs:

($-V_3$ during the formation of a solid white portion)>($-V_3$ during the formation of a solid black portion). Further, during the formation of a solid white portion, $$V_1 \approx V_2 > V_3,$$

during the formation of a solid black portion, $$V_1 \approx V_2 \approx V_3.$$

Therefore, while the solid white portion of an image being formed is formed, the negatively charged particles stagnate in the upstream adjacencies of the charging nip. Then, they are expelled by an excessive amount from the charge roller 1 onto the photoconductive drum 6, as the image formation process is switched from the solid white portion forming process to the solid black portion forming process. The time it takes for the excessive amount of the expelled negatively charged particles to pass the development station e, from the moment (t=0 [sec]) the image formation process is switched from the solid white portion forming process to the solid black portion forming process, is calculated as follows.

While a solid white portion is formed, the exposure lamp 8 is on, whereas while a solid black portion is formed, the exposure lamp 8 is off.

Referring to FIGS. 1 and 2, the relationship among: the time ($t_4$) from the moment the exposure lamp 8 is turned off, to the moment the line of surface potential level gap enters the charging nip n; time ($t_2$) from the moment the negatively charged particles stagnating in the upstream adjacencies of the charging nip are released, to the moment they are expelled in the downstream adjacencies of the charging nip after remaining on the charge roller while the charge roller rotates approximately once; time ($t_3$) it takes for the expelled negatively charged particles to move from the downstream edge of the charging nip to the center of the development station, are:

$$t_4=(2\pi-\theta_1-\phi_1/2)/w_1,$$

$$t_2=(2\pi-\phi_2)/w_2,$$

$$t_3=(\theta_1+\theta_2-\phi_1/2)/w_1.$$

Therefore, in order to recover, by the developing device 3, the excessive amount of the negatively charged particles expelled from the charge roller 1 onto the photoconductive drum 6, the apparatus is set up so that the development AC voltage for recovering the negatively charged particles, will be being continuously applied to the developing device 3, by the time $(2\pi+\theta_2-\phi_1)/w_1+(2\pi-\phi_2)/w_2$ [sec] elapses after the moment the state of the exposure lamp 8 changes from the ON-state to the OFF-state.

It is preferred that the development AC voltage is applied for a duration of $(t_{42}-t_{43})$ long enough to recover, by the developing device 3, most of the excessive amount of the negatively charged particles expelled from the charge roller 1 onto the photoconductive drum 6, with $t_{41}=(2\pi-\theta_2-\phi_1)/w_1+(2\pi-\phi_2)/w_2$ [sec] being the mid point of $(t_{42}-t_{43})$.

The application of Embodiment 8 is not limited to the case of the switching of the image formation process from the non-image formation process to the image formation process. The phenomenon with which Embodiment 8 is concerned also occurs as the image formation process changes from the exposing process to the non-exposing process. For example, when an attempt is made to print immediately after the preparatory post-rotation, a phenomenon similar to the phenomenon with which Embodiment 8 is concerned, occurs.

Embodiment 9 (FIG. 8)

This embodiment of an operational sequence relates to the image forming apparatus (FIG. 17), which exposes the points (areas) of toner nonadhesion. In this sequence, the development bias is applied to recover or reuse the excessive amount of the positively charged particles, which are expelled from the charge roller 1 onto the photoconductive drum 6 as the surface potential level of the photoconductive drum changes due to the switching of the charge removal rotation of the photoconductive drum from the first to the second.

The sequence is the same as the one shown in FIG. 8. The developer is positively charged, whereas the photoconductive drum is negatively charged. In this embodiment, $-V_3$ takes on a negative value.

As described before, as the surface potential level of the photoconductive drum changes due to the switching of the charge removal rotation of the photoconductive drum 6 from the first rotation to the second rotation, the following condition occurs:

$$V_3>V_2>V_1=0\ [V],\ \text{and}$$

$|V_3-V_1|$ during the first drum rotation$>|V_3-V_1|$ during the second drum rotation.

Therefore, the positively charged particles stagnate in the upstream adjacencies of the charging nip. However, the force which confines the positively charged particles is stronger during the first charge removal rotation of the photoconductive drum than during the second charge removal rotation of the photoconductive drum. Thus, an excessive amount of the positively charged particles is expelled from the charge roller 1 onto the photoconductive drum 6 at the moment the switching. The time it takes for the excessive amount of the expelled positively charged particles to pass the development station from the moment (t=0 [sec]) of the switch from the first charge removal rotation of the photoconductive drum 6 to the second charge removal rotation of the photoconductive drum 6, is calculated as follows.

Referring to FIGS. 1 and 2, the relationship among: the time ($t_1$) from the moment the electrical charge begins to be removed from the photoconductive drum 6, to the moment the point of the surface potential level change on the peripheral surface of the photoconductive drum 6 enters the charging nip n; time ($t_2$) from the moment the positively charged particles stagnating in the upstream adjacencies of the charging nip are released, to the moment they are expelled in the downstream adjacencies of the charging nip after remaining on the charge roller 1 while the charge roller 1 rotates approximately once; and time ($t_3$) it takes for the expelled positively charged particles to move from the downstream edge of the charging nip to the center of the development station, are:

$$t_1=(2\pi-\phi_1/2)/w_1,$$

$$t_2=(2\pi-\phi_2)/w_2,$$

$$t_3=(\theta_1+\theta_2-\phi_1/2)/w_1.$$

Therefore, in order to recover, by the developing device 3, the excessive amount of the positively charged particles expelled from the charge roller 1 onto the photoconductive drum 6, the apparatus is set up so that the development AC voltage for recovering the positively charged particles, will be being continuously applied to the developing device 3, by the time $(2\pi+\theta_1+\theta_2-\phi_1)/w_1+(2\pi-\phi_2)/w_2$ [sec] elapses after the moment the electrical charge begins to be removed from the photoconductive drum 6.

It is preferred that the development AC voltage is applied long enough to recover, by the developing device 3, most of the excessive amount of the positively charged particles expelled from the charge roller 1 onto the photoconductive drum 6, so that $t_{6/1}=(2\pi-\theta_2-\phi_1)/w_1+(2\pi-\phi_2)/w_2$ [sec] becomes the mid point of the period in which the development AC voltage is applied.

Further, the difference in potential level between the line of surface potential level gap, on the peripheral surface of the photoconductive drum 6, during the x-th charge removal rotation of the photoconductive drum 6 is smaller than that during the (x−1)-th charge removal rotation of the photoconductive drum 6. It is desired, however, that the development AC bias is continuously applied until the charge removal rotation of the photoconductive drum 6 is stopped.

Next, an example of an image forming apparatus in accordance with the present invention will be described in Embodiment 10.

Figure 9:
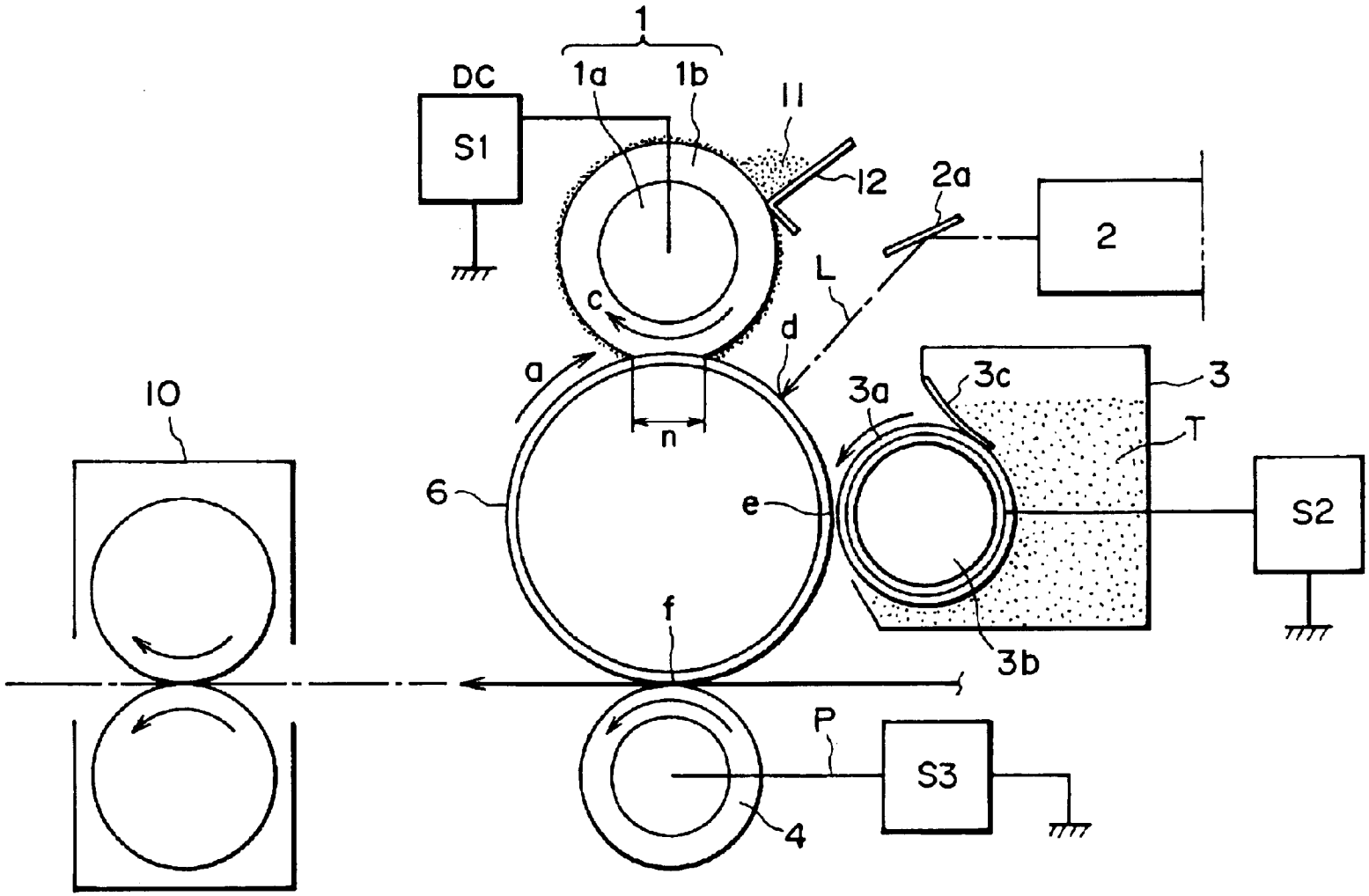
FIG. 9 is a schematic sectional view of an example of an image forming apparatus in which electrically conductive particles are present in the charging nip which the photoconductive drum and charge roller form between them, for showing the general structure thereof.
Figure 10:
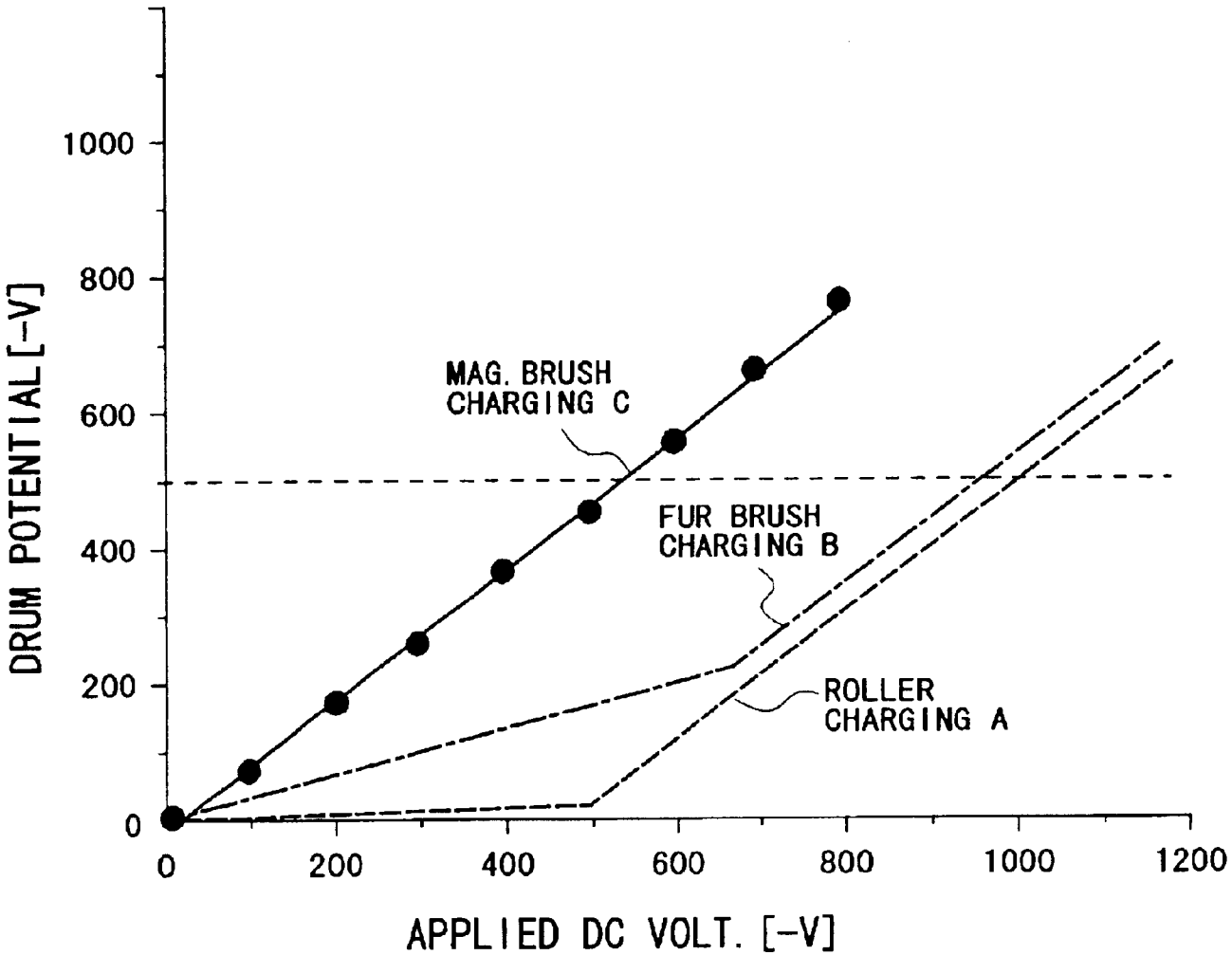
FIG. 10 is a graph showing the charging performances of various contact type charging devices.

Embodiment 10 (FIG. 9)

FIG. 9 shows an image forming apparatus, in which electrically conductive charging performance enhancement particles 11 are in the nip n which the photoconductive drum 6 and charge roller 1 form.

The image forming apparatus in FIG. 9 is similar to the apparatus in FIG. 17, which does not have a cleaner, counter rotates the charging member, and has an exposing apparatus for exposing the points (areas) of toner adhesion. However, it is different from the apparatus in FIG. 17, in that this apparatus has a member 12 for coating the charge roller 1 with the charging performance enhancement particles 11, so that the electrically conductive charging performance enhancement particles 11 can be placed in the nip n, which the photoconductive drum 6 and charge roller 1 form, by coating the charge roller 1 with the electrically conductive charging performance enhancement particles 11. Otherwise, the structure of this apparatus is the same as that of the apparatus in FIG. 17, and therefore, will not be described.

The developer T and photoconductive drum 6 are charged to the negative polarity. The charging performance enhancement particles 11 are electrically conductive, and enhance the electric current flow into the photoconductive drum 6. As for the type of the charging performance enhancement particles 11, those which are positively charged relative to the developer T, are used.

The charging performance enhancement particles 11 also stagnates, or are expelled, in the upstream adjacencies of the charging nip. Whether the charging performance enhancement particles 11 stagnate or are expelled is determined by the state of the surface potential level of the photoconductive drum 6. Further, if the distribution of the charging performance enhancement particles 11 in the nip n between the photoconductive drum 6 and charge roller 1 is nonuniform, the photoconductive drum 6 is nonuniformly charged, resulting in image defects.

Therefore, the distribution of the charging performance enhancement particles 11 in the nip n between the photoconductive drum 6 and charge roller 1 must be uniform. The distribution of the charging performance enhancement particles 11 on the peripheral surface of the photoconductive drum 6 can be made uniform by recovering into the developing device 3, the excessive amount of the charging performance enhancement particles 11 expelled from the charge roller 1 onto the photoconductive drum 6 in the downstream adjacencies, with the use of a method similar to the methods presented in the descriptions of the preceding embodiments.

This embodiment of an image forming apparatus does not have a cleaner. However, an image forming apparatus may be provided with a cleaner to ensure that it will produce satisfactory images.

Embodiments 1–10 may be carried out in combination.

Miscellanies

Although, none of the above described embodiments of an image forming apparatus in accordance with the present invention has a cleaner, they may be equipped with a cleaner. However, the effects of the present invention are most apparent when the present invention is applied to an image forming apparatus with no cleaner.

In the case of an image forming apparatus, which is 100 [mm/s] in process speed, 30 [mm] in photoconductive drum diameter, counter rotates relative to the photoconductive drum 6, 60 [mm/s] in the surface velocity relative to the photoconductive drum 6, and 20 [mm] in charge roller diameter, the length of the time the particles stagnating in the upstream adjacencies of the charging nip were expelled was 0.01 [s].

This length of time was approximated from the width (1 mm) of the contamination of an outputted image traceable to the excessive amount of the developer expelled after stagnating in the upstream adjacencies of the charging nip.

Thus, all that is necessary to prevent this image forming apparatus from forming an image suffering from the image contamination traceable to the excessive amount of the particles expelled after stagnating in the upstream adjacencies of the charging nip, is to apply the particle recovery bias to the developing device 3, for a duration of at least 5 mm/$V_{PS}$, that is, from 2.5 mm/$V_{PS}$ before the moment of the particle expulsion to 2.5 mm/$V_{PS}$ after the moment of particle expulsion.

It is preferable that the particle recovery bias is applied to the developing device 3 for a duration of at least 10 mm/$V_{PS}$ ($V_{PS}$ is process speed of image forming apparatus), that is, from 5 mm/$V_{PS}$ before the moment of the particle expulsion until 5 mm/$V_{PS}$ after the moment of the particle expulsion.

In the preceding embodiments, the entirety of the peripheral surface of the photoconductive drum 6 in the image forming apparatus (FIG. 7) equipped with an exposing apparatus which exposes the points (areas) of toner nonadhesion, is exposed after being charged. However, it does not need to be charged prior to the exposure. When it is not charged prior to the exposure, the conditions under which the particles stagnate in the upstream adjacencies of the charging nip differ from the above described ones, and therefore, the particle recovery sequence must be modified accordingly.

The sequence for controlling the image forming apparatus in accordance with the present invention does not need to be limited to those described above. In other words, any control sequence will suffice as long as it is capable of recovering the particles, which are expelled by the surface potential level change of the image bearing member, after stagnating in the upstream adjacencies of the charging nip, and which bypass the charging nip by way of the peripheral surface of the charging member, into the developing device of an image forming apparatus, which does not have a cleaner, and has a charging device comprising a charging member counter rotated relative to an image bearing member.

The image bearing member may be an electrostatically recordable dielectric member, or the like. In the case of an electrostatically recordable dielectric member or the like, the surface of the dielectric member is uniformly charged to predetermined polarity and potential level, and then, an intended electrostatic latent image is written by removing the electrical charge from the selected points of the uniformly charged surface of the dielectric member with the use of a charge removing means such as an electron gun.

The waveform of the alternating component of the bias (voltage) applied to the developer bearing member of the developing apparatus is optional; it may be sinusoidal, rectangular, triangular, etc. Further, the alternating voltage component may be in the form of rectangular waves created by periodically turning on and off a DC power source.

As described above, according to the present invention, it is possible to prevent the phenomenon that as the surface potential level of an image bearing member changes, the particles, for example, developer particles, stagnating in the upstream adjacencies of the charging nip are released, in a line parallel to the axial direction of the image bearing member, which results in image contamination and/or wasteful developer consumption, by adjusting the signal time line so that the voltage for recovering or reusing the released developer is applied to the developing device in synchronism with the expulsion of the developer from the charging device.

Similarly, the wasteful consumption of the charging performance enhancement particles, or the like, which play a significant role in image formation, can be prevented by recovering the particles, by the developing device, as soon as the particles are expelled by an excessive amount from the charging device onto the image bearing member.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

an image bearing member;

a charging roller cooperable with said image bearing member to form a nip therebetween, for charging said charging roller is rotatable for counterdirectional peripheral movement relative to said image bearing member at the nip;

developing means for developing with a developer an electrostatic image formed on said image bearing member;

wherein a potential of a potential changing portion of said image bearing member changes with respect to a peripheral moving direction of said image bearing member, wherein at tA (sec) after arrival, at an upstream end of said nip, of said potential changing portion, said developing means is supplied with a voltage for collecting particles from said image bearing member to said developing means, where tA (sec) is a sum of a time duration required for a surface of said charging roller to move from the upstream end of said nip to a downstream end of said nip and a time duration required for a surface of said image bearing member to move from the downstream end of said nip to a developing zone of said developing means.

2. An apparatus according to claim 1, wherein said developing means is supplied with a voltage for collecting the particles from said image bearing member to said developing means during the time from tA−5/(2Vps) after the arrival to tA+5/(2Vps) after the arrival, where Vps(mm/sec) is a speed of movement of the surface of said image bearing member.

3. An apparatus according to claim 1, wherein said developing means is supplied with a voltage for collecting the particle from said image bearing member to said developing means during the time from tA−5/Vps after the arrival to tA+5/Vps after the arrival, where Vps (mm/sec) is a speed of movement of the surface of said image bearing member.

4. An apparatus according to claim 1, wherein said developing means is capable of collecting a residual developer from said image bearing member.

5. An apparatus according to claim 1, wherein said potential changing portion is provided by beginning of charging of said image bearing member by said charging roller.

6. An apparatus according to claim 1, further comprising transferring means for transferring a developed image from said image bearing member onto an image receiving member, wherein said potential changing portion is provided by change of a voltage applied to said transferring means.

7. An apparatus according to claim 1, wherein said image bearing member is a photosensitive member, said apparatus further comprising exposure means for exposing said photosensitive member to form an electrostatic image on said photosensitive member, and wherein said potential changing portion is formed by an exposed portion and a non-exposed portion of said photosensitive member.

8. An apparatus according to claim 7, wherein said exposure means is a laser scanner, wherein said potential changing portion is provided by adjustment of a laser power of said laser scanner.

9. An apparatus according to claim 1, further comprising discharging means for electrically discharging said image bearing member, wherein said potential changing portion is provided by beginning of discharging by said discharging means.

10. An apparatus according to claim 9, wherein said charging roller functions also as said discharging means.

11. An apparatus according to claim 1, wherein said developing means effects reverse development of the electrostatic image with the developer.

12. An apparatus according to claim 11, wherein said image bearing member is a photosensitive member, said apparatus further comprising exposure means for exposing a portion of said photosensitive member to receive the developer to form the electrostatic image.

13. An apparatus according to claim 1, wherein said developing means effects regular development of the electrostatic image with the developer.

14. An apparatus according to claim 13, wherein said image bearing member is a photosensitive member, said apparatus further comprising exposure means for exposing a portion of said photosensitive member not to receive the developer to form the electrostatic image.

15. An apparatus according to claim 1, wherein the particles are developer particles, or the particles have a polarity which is the same as that of a regular charging polarity of the developer.

16. An apparatus according to claim 1, wherein the particles have a polarity which is opposite the regular charging polarity of the developer.

17. An apparatus according to claim 1, wherein said charging roller includes an elastic layer.

18. An apparatus according to any one of claims 1–17, wherein electroconductive particles are provided in said nip.

19. An apparatus according to claim 18, wherein the electroconductive particles have particle sizes smaller than a pixel size of the electrostatic image.

20. An apparatus according to claim 18, wherein the electroconductive particles have a resistivity not more than $1\times10^{12}$ Ωcm.

21. An apparatus according to claim 16, wherein the particles having the opposite polarity are electroconductive particles provided in the nip.

* * * * *

UNITED STATES PATENT AND TRADEMARK OFFICE

CERTIFICATE OF CORRECTION

PATENT NO. : 6,839,530 B2
DATED : January 4, 2005
INVENTOR(S) : Norio Takahashi et al.

It is certified that error appears in the above-identified patent and that said Letters Patent is hereby corrected as shown below:

Title page,
Item [56], References Cited, U.S. PATENT DOCUMENTS, "09134105 A * 5/1997" should read -- 9-134105 A * 5/1997 --.

Column 8,
Line 12, "word," should read -- words, --.

Column 10,
Lines 11, 18 and 24 "rotates" should read -- rotate --.

Column 11,
Line 49, "rotates" should read -- rotate --.

Column 14,
Line 12, "rotates." should read -- rotate. --.

Column 16,
Line 1, "in case" should be deleted; and
Line 2, "state," should be deleted.

Column 23,
Line 10, "be" (first occurrence) should be deleted;
Line 13, "occurs" should read -- occur --; and
Line 22, "nest" should read -- next --.

Column 25,
Line 67, "being" should be deleted.

Column 26,
Lines 26, 44 and 67, "being" should be deleted.

Column 27,
Lines 24, 49 and 66, "being" should be deleted.

Column 28,
Line 65, "being" should be deleted.

Column 30,
Line 54, "being" should be deleted;

UNITED STATES PATENT AND TRADEMARK OFFICE

CERTIFICATE OF CORRECTION

PATENT NO. : 6,839,530 B2
DATED : January 4, 2005
INVENTOR(S) : Norio Takahashi et al.

It is certified that error appears in the above-identified patent and that said Letters Patent is hereby corrected as shown below:

Column 30 (cont'd),
Line 56, "$t_1+t_2+t_3=(2\pi+\phi_1+\phi_2-\phi_1)/w_1+(2\pi-\phi_2)/w_2$" should read -- $t_1+t_2+t_3=(2\pi+\theta_1+\theta_2-\phi_1)/w_1+(2\pi-\phi_2)/w_2$ --; and
Line 57, "the" (second occurrence) should be deleted.

Column 32,
Line 13, "being" should be deleted.

Column 33,
Line 25, "being" should be deleted.

Column 34,
Line 34, "being" should be deleted.

Column 35,
Line 42, "being" should be deleted.

Column 36,
Line 48, "being" should be deleted.

Column 39,
Line 27, "being" should be deleted; and
Line 35, "$t_{41}=(2\pi-\theta_2-\phi_1/)$" should read -- $t_{41}=(2\pi+\theta_2-\phi_1)$ --.

Signed and Sealed this

Seventh Day of June, 2005

JON W. DUDAS
*Director of the United States Patent and Trademark Office*